US006246221B1

(12) United States Patent
Xi

(10) Patent No.: US 6,246,221 B1
(45) Date of Patent: Jun. 12, 2001

(54) PMOS LOW DROP-OUT VOLTAGE REGULATOR USING NON-INVERTING VARIABLE GAIN STAGE

(75) Inventor: Xiaoyu Xi, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/665,816

(22) Filed: Sep. 20, 2000

(51) Int. Cl.[7] ..... G05F 1/40
(52) U.S. Cl. ..... 323/280
(58) Field of Search ..... 323/280, 316, 323/313, 274

(56) References Cited

U.S. PATENT DOCUMENTS 5,168,209 * 12/1992 Thiel ..... 323/313
5,563,501 * 10/1996 Chan ..... 323/282

* cited by examiner

*Primary Examiner*—Shawn Riley
(74) *Attorney, Agent, or Firm*—Dwight N. Holmbo; Wade James Brady, III; Frederick J. Telecky, Jr.

(57) ABSTRACT

A high power supply ripple rejection (PSRR) internally compensated low drop-out voltage regulator using an output PMOS pass device. The voltage regulator uses a non-inversion variable gain amplifier stage to adjust its gain in response to a load current passing through the output PMOS device such that as the load current decreases, the gain increases, wherein a second pole associated with the voltage regulator is pushed above a unity gain frequency associated with the voltage regulator. The non-inversion variable gain amplifier is further operational to adjust its gain in response to a load current passing through the power PMOS device such that as the load current increases, the gain decreases, wherein the voltage regulator unity gain bandwidth associated with the loop formed by the compensation capacitor is kept substantially constant.

25 Claims, 26 Drawing Sheets

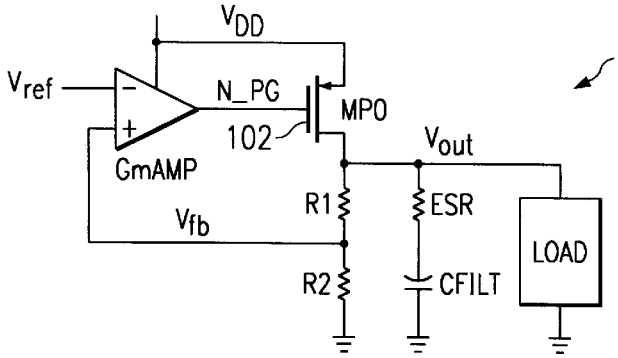
FIG. 1
(PRIOR ART)
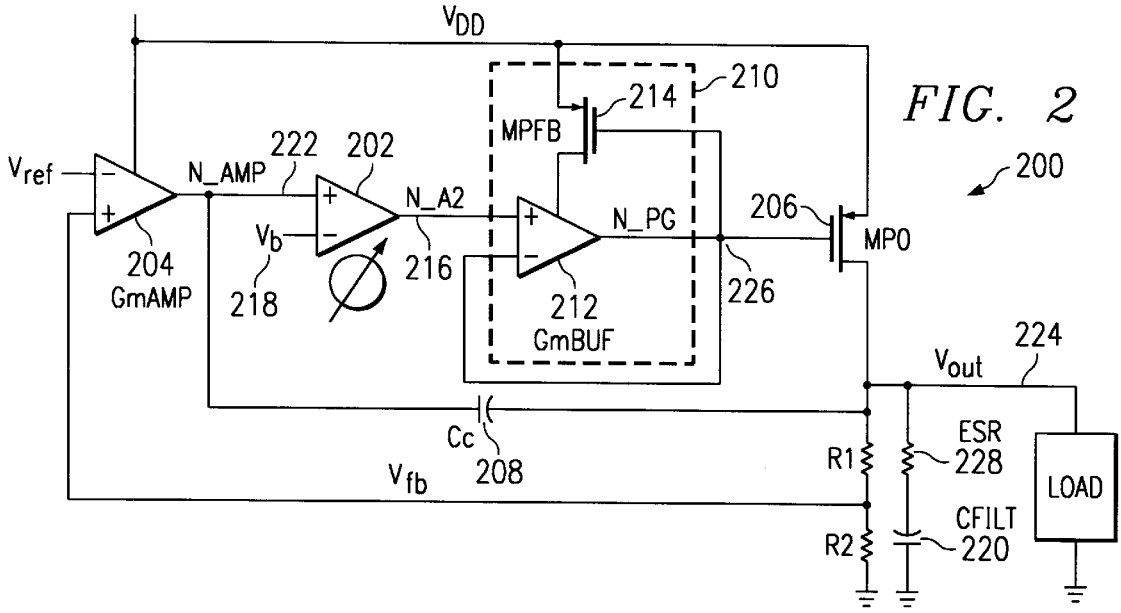
FIG. 2
FIG. 3
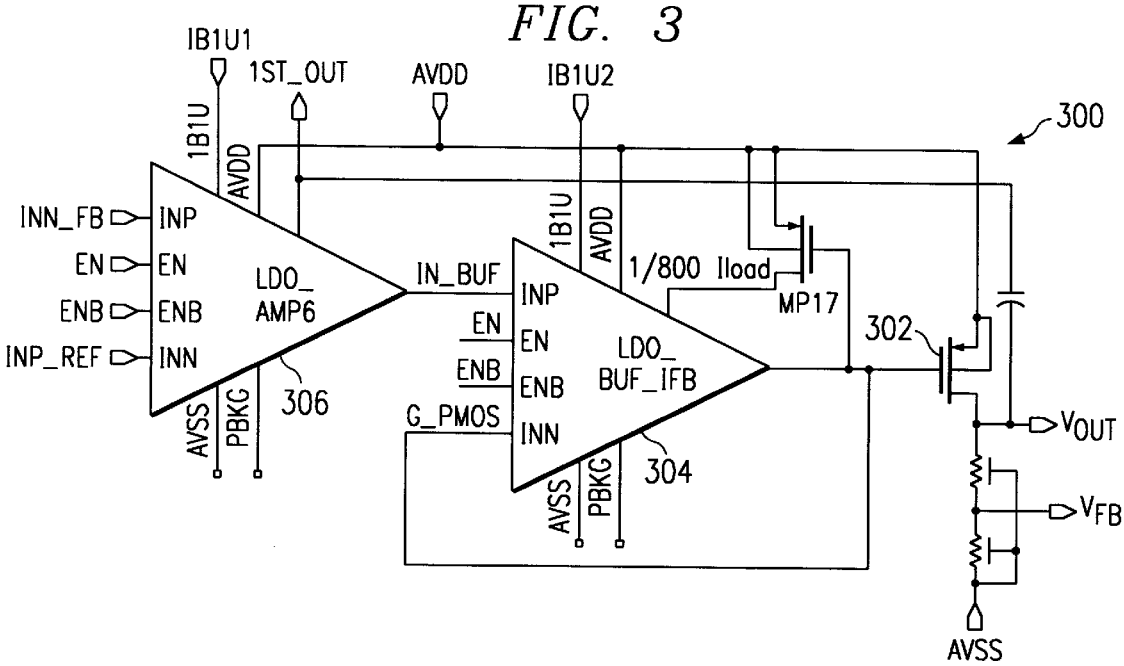

: phase(VF("/VOL_LV_HILD"))
: dB20(VF("/VOL_HV_HILD"))
: dB20(VF("/VOL_LV_HILD"))
: phase(VF("/VOL_HV_LOWLD"))
: phase(VF("/VOL_HV_HILD"))
: dB20(VF("/VOL_HV_LOWLD"))
200
100
0.00
-100
-200
-300
-400
(deg, dBV)
10m
100m
1
10
100
1K
10K
100K
1M
10M
AC RESPONSE ——— : dB20(VF("/PSR_HV_2"))
------ : dB20(VF("/PSR_LV_2"))
(dBV)
0.00
-10.0
-20.0
-30.0
-40.0
-50.0
-60.0
-70.0
-80.0
-90.0
-100
-110
10m
100m
1
10
100
1K
10K
100K
1M
10M
100M

PMOS LOW DROP-OUT VOLTAGE REGULATOR USING NON-INVERTING VARIABLE GAIN STAGE

BACKGROUND OF THE INVENTION

1. Field of the Invention

This invention relates generally to voltage regulators, and more particularly to an internally compensated low drop-out (LDO) voltage regulator using a non-inverting variable gain stage to improve stability and optimize power supply rejection ratio (PSRR).

2. Description of the Prior Art

Active compensating capacitive multiplier structures and techniques, e.g. nested Miller compensation, are well known in the art. The specific type of compensating circuit used is dependent upon the particular application. One application of improving phase margin for example, takes advantage of the Miller Effect by adding a Miller compensation capacitance in parallel with an inverting gain stage, e.g., the output stage of a two stage amplifier circuit. Such a configuration results in the well-known and desirable phenomenon called pole splitting, which advantageously multiplies the effective capacitance of the physical capacitor employed in the circuit. See, e.g., for background on compensation of amplifier circuits using Miller-compensating capacitance, Paul R. Gray and Robert g. Meyer, *Analysis and Design of Analog Integrated Circuits,* Third Ed., John Wiley & sons, Inc. New York, 1993, Ch. 9, especially pp. 607–623.

Recent trends associated with high efficiency battery powered equipment are creating increased demand for power management systems using DC/DC converters feeding low drop-out (LDO) voltage regulators. Applications requiring power from such LDO voltage regulators are becoming more sensitive to noise as application bandwidth requirements are pushed ever upward. This places far greater importance on the power supply ripple rejection (PSRR) characteristics associated with LDO voltage regulators since LDO voltage regulators are used to both clean up the output noise of the DC/DC converter and to provide power supply cross talk immunity from application blocks sharing the same raw DC supply.

There is also a trend showing an increased use of ceramic capacitors as output decoupling capacitors as contrasted with the once more typical use of tantalum capacitors in such applications. The significantly low equivalent series resistance (ESR) associated with ceramic capacitors however, makes reliance on ceramic output capacitor ESR characteristics no longer feasible to stabilize an LDO amplifier control loop. Thus, a need exists in the LDO amplifier art for an internal compensation technique allowing use of a wide range of output capacitor types. Such internal compensation techniques would allow the use of much smaller output capacitors and therefore provide a means for reducing both PCB real estate requirements and external component costs.

One widely popular accepted technique associated with internal compensation is known as "Pole splitting" or "Miller Compensation" such as discussed herein above. Miller compensation, however, provides an impedance shunt across the series pass device associated with LDO voltage regulators, via the compensation capacitor and Cgs. This impedance is undesirable since it causes an early roll-off in PSRR.

Some conventional two-stage PMOS low drop-out voltage regulators suffer from very poor load regulation at light, or no load, conditions. This is due to the gate of the PMOS series pass being driven from a source follower, Vdsat+Vgs, where Vt can vary from +0.2 to −0.2V for a natural NMOS device and +0.5 to +0.9V for a standard device. Such variations will ultimately force the first stage amplifier output devices to enter their triode region (linear mode) when the regulator is lightly loaded, resulting in a significant reduction in loop gain and hence deterioration in regulator performance.

The basic architecture for a PMOS voltage regulator includes an error amplifier to drive a power PMOS transistor, that supplies load current anywhere from zero up to hundreds of milli-amperes. Generally, a very large external filter capacitor (micro-farad range), is connected at the output node to improve transient response when load current changes quickly and dramatically. A block diagram of this basic architecture is shown in FIG. 1.

Due to its special application, a PMOS voltage regulator has very unique load-dependent open loop frequency response characteristics. Under high supply voltage and minimum load current conditions, the power PMOS transistor operates in its sub-threshold region which produces a very large output impedance (hundreds of kilo-ohms range or more), wherein the output node will generate a low frequency pole. Under low supply voltage and maximum load current conditions, the PMOS transistor is well into its triode region in which the output impedance is extremely low (tens of ohms or less), wherein the pole at the output node is pushed out to the kilohertz range. The decades of movement associated with the pole presents significant design challenges, especially regarding stability compensation.

Given the nature that the foregoing LDO is basically a two-stage amplifier, using a Miller capacitor for compensation is a very attractive approach. Tying a capacitor $C_c$ from the output node $V_{out}$ to the gate input N_PG of the PMOS transistor however, does not provide a desirable solution for two reasons: First, the two poles might not be separated far enough. For example, if the dominant pole is at N_PG due to the Miller effect, having a frequency at $$f_{pd} = \frac{g_{oAMP}}{2\pi C_c(1 + G_{mMPO} \cdot r_{oMPO})},$$

then the second pole comes in at a frequency of $$f_{p2} = \frac{G_{mMPO}}{2\pi CFILT}.$$

The distance between the two poles is:

$$D_{p1p2} = \frac{f_{p2}}{f_{pd}} = \frac{G_{mMPO}}{2\pi \cdot CFILT} \cdot \frac{2\pi C_c(G_{mMPO} \cdot r_{oMPO})}{g_{oAMP}} = \frac{C_c(G^2_{mMPO} \cdot r_{oMPO} \cdot r_{oAMP})}{CFILT}.$$

CFILT is generally much larger than $C_c$ (50,000 times larger if CFILT is 4.7 $\mu$F and $C_c$ is 90 pF. Even if the product of $G^2_{mMPO} \cdot r_{oMPO} \cdot r_{oAMP}$ is large which basically equals the gain of a two-stage amplifier, $f_{pd}$ and $f_{p2}$ are still not too far apart. Thus, the circuit will either suffer too poor phase margin or too low open-loop gain. Actually, it is possible that at low load current, the dominant pole is very likely at $V_{out}$; and at high load current, when $G_{mMPO}$ is significantly larger, the dominant pole is then at N_PG. Thus, an even worse scenario can occur somewhere along the load current in which the two poles are closest to each other resulting in a "pole swapping" point.

Second, the $C_c$ will degrade the PSRR performance. A simple way to look at this characteristic is: the $C_c$ in series with CFILT to ground directly loads the error amplifier, so when the ripple frequency on the supply line increases, the impedance from N_PG to ground decreases, which effectively "clamps" the gate voltage of MPO referenced to ground. The gate voltage will therefore not be able to track the ripples injected into the MPO source. This directly modulates the $V_{gs}$ of MPO and therefore also $V_{out}$.

In view of the foregoing, a need exists for an amplifier circuit architecture and technique capable of achieving better stability and higher PSRR performance from an internally compensated PMOS low drop-out voltage regulator than that presently achievable using conventional "Miller" or "Pole-splitting" techniques presently known in the art.

SUMMARY OF THE INVENTION

The present invention is directed to a circuit architecture and technique for achieving good phase margin, highly desirable open-loop gain, and high power supply ripple rejection (PSRR) from an internally compensated PMOS low drop-out voltage regulator that is implemented to formulate a modified type of Miller compensation. This good phase margin and high open-loop gain is achieved by using a non-inverting variable gain stage that ensures the dominant pole is always at the same internal node regardless of load current (no "pole swapping" allowed). The present circuit further provides high PSRR by implementing the variable gain single stage amplifier such that a differential input has one input tied to $C_c$ while the other is at a dc voltage referenced to ground. Properly setting the input reference improves the PSRR.

A conventional PMOS low drop-out voltage regulator is generally comprised of two gain stages in order to promote simplification of any related compensated closed loop system. The input stage of such a voltage regulator is formulated via a differential amplifier. The output stage comprises a series pass PMOS device. These two stages are generally coupled together via an impedance buffer, typically a source follower, to enable the input stage high impedance output to drive the large gate capacitance of the series pass PMOS device and thereby minimize the effect of an internal pole that would otherwise interfere with loop compensation. Miller capacitor multiplication, or "Pole-splitting", is generally used by those skilled in the art to internally compensate the voltage regulator for use with ceramic output capacitors where the circuit designer cannot rely on an external compensating zero formed by the ESR associated with an electrolytic capacitor. The impedance shunt formed through the Miller compensation capacitor and PMOS Cgs using this approach however, generates a PSRR that rolls off earlier than that associated with the open loop control performance of the regulator. Further, connecting the Miller capacitor across only the pass PMOS device usually results in pole swapping over the full load current range, as discussed herein before. In view of the foregoing, the present invention provides a low drop-out (LDO) architecture that employs a variable gain stage to improve the internal compensation and achieve high PSRR performance from an internally compensated PMOS LDO voltage regulator.

A preferred embodiment of the present invention comprises a differential amplifier input stage, a variable gain, non-inversion, single stage differential amplifier second stage, and an output stage comprising a series pass PMOS device. The second and output stages are coupled together via an impedance buffer (e.g., source follower, or unity-gain feedback amplifier) to enable the input stage high impedance output to drive the large gate capacitance of the series pass PMOS device and thereby minimize the effect of an internal pole that would otherwise interfere with loop compensation. The non-inversion variable gain differential amplifier stage has one input tied to $C_c$ and the other tied to a dc voltage referenced to ground. The Miller capacitance is then tied across multiple stages, i.e. the variable gain stage, the buffer, and the power PMOS.

A feature of the present invention is associated with a higher frequency pole at the filter capacitor achieved through partitioning the LDO into a two stage amplifier and using miller capacitance for the compensation wherein the $G_m$ of the power PMOS is boosted at low load current and cut down at high load current using a wide band non-inversion variable gain stage.

Another feature of the present invention is associated with better PSRR at high frequency by preventing the Miller capacitor from shunting the gate and drain of the pass PMOS device (in one embodiment, the left plate of the Miller capacitor is tied to one input of the variable gain stage while the other input is referenced to ground).

Another feature of the present invention is associated with a unity-gain feedback configured Operational Transconductance Amplifier (OTA) gate drive circuit that substantially eliminates poor DC load regulation generally identified with conventional source follower drivers.

Yet another feature of the present invention is associated with a flexible internally compensated PMOS low drop-out voltage regulator capable of functioning with a wide range of output capacitors.

BRIEF DESCRIPTION OF THE DRAWINGS

Other aspects and features of the present invention and many of the attendant advantages of the present invention will be readily appreciated as the same become better understood by reference to the following detailed description when considered in connection with the accompanying drawings in which like reference numerals designate like parts throughout the figures thereof and wherein:

FIG. 1 illustrates a very well known low drop-out (LDO) voltage regulator using a PMOS pass device;

FIG. 2 illustrates a PMOS LDO according to one embodiment of the present invention;

FIG. 3 illustrates a PMOS LDO design according to one embodiment of the present invention using a traditional analog process;

FIG. 16 FIG. 3 illustrates a PMOS LDO design in advanced digital process according to one embodiment of the present invention;

Figure 4:
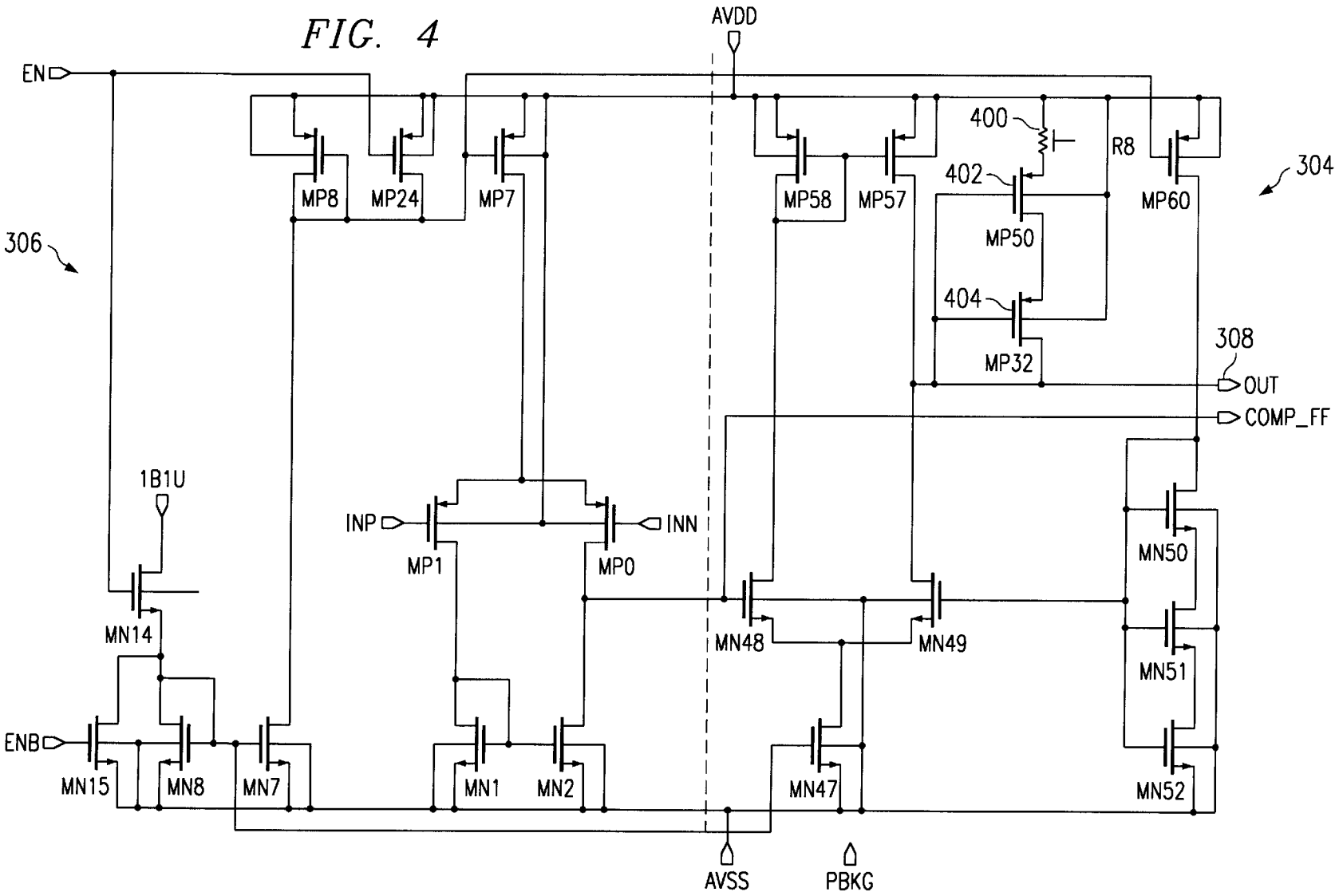
FIG. 4 illustrates a more detailed view of the error amplifier stage and the non-inversion gain stage of the PMOS LDO shown in FIG. 3.

While the above-identified drawing figures set forth alternative embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

FIG. 1 illustrates a low drop-out (LDO) voltage regulator 100 using a PMOS pass device 102 and is well-known in the prior art; while FIG. 2 illustrates a PMOS LDO 200 according to one embodiment of the present invention. The PMOS LDO 200 importantly resolves the potential poor phase margins, low open-loop gains and less than desirable PSRR performance discussed herein above associated with the circuit architecture shown in FIG. 1. The PMOS LDO 200 ensures that the dominant pole is always at the same internal node, regardless of load current, by preventing "pole swapping." The foregoing analysis shows that one must boost $G_{mMPO}$ to split $f_{pd}$ and $f_{p2}$ even further. One straightforward way to accomplish this is to insert a non-inversion gain stage $A_2$ (202) from the error amplifier 204 output to the PMOS 206 gate, and tie the Miller capacitor ($C_c$) 208, still at the error amplifier 204 output. This will cause the LDO's 200 dominant pole and second pole frequencies to be:

$$f_{pd} = \frac{g_{oAMP}}{2\pi C_c(1 + A_2 \cdot G_{mMPO} \cdot r_{oMPO})} \tag{1}$$

and $$f_{p2} = \frac{A_2 \cdot G_{mMPO}}{2\pi \cdot CFILT} \tag{2}$$

where $f_{p2}$ is pushed further by a factor of $A_2$, and the distance between the two poles (1) and (2) is $$D_{p1p2} = \frac{f_{p2}}{f_{pd}} = \frac{C_c(A_2^2 \cdot G_{mMPO}^2 \cdot r_{oMPO} \cdot r_{oAMP})}{CFILT}. \tag{3}$$

Importantly, the −3 dB bandwidth of the non-inversion gain stage ($A_2$) 202 should be much larger than the overall LDO 200 bandwidth, which is $$f_{bwLDO} = \frac{G_{mAMP}}{2\pi C_c}, \tag{4}$$

otherwise the ($A_2$) 202 stage will introduce undesired phase shift. To achieve the requisite high −3 dB bandwidth, a buffer 210 is needed for the ($A_2$) 202 stage to drive the power PMOS 206. Most commonly, a source follower, either a PMOS or NMOS device such as an isolated zero-Vt MOS will provide the requisite buffering characteristics so long as it preserves the necessary headroom for Vgs drive of the power PMOS 206. A source follower will not provide the requisite buffering characteristics where no special devices are available and the supply voltage is getting ever lower however, such as when implementing a more advanced digital CMOS process. The buffer 210 can be seen to be implemented using both a unity-gain feedback single-stage amplifier 212 and a PMOS 214 in order to provide the requisite buffering characteristics. The unity-gain feedback single-stage amplifier 212 provides the same closed-loop bandwidth as a commonly used source follower and further allows the input/output to be designed rail-to-rail, thereby providing important advantages for low voltage applications. Since the buffer 210 input presents a high impedance input node 216, circuit components need careful selection to push out the pole at the input node 216.

The non-inversion gain stage ($A_2$) 202 is a differential input, single stage amplifier having one input tied to $C_c$ 208 and the other input tied to a dc voltage $V_b$ 218 referenced to ground. This configuration was found to improve the PSRR since $C_c$ 208 in series with CFILT 220 present a low impedance to ground at high frequencies.

Since the Miller capacitance $C_c$ 208 is tied across multiple stages, i.e. variable gain stage ($A_2$) 202, buffer 210 and power PMOS 206, more poles are present than that generated in a single stage Miller compensation implementation for an LDO similar to that illustrated in FIG. 1. The loop formed by Miller capacitance $C_c$ 208 is itself a local unity-gain feedback at high frequencies; and therefore the LDO 200 must be implemented to ensure the loop formed by Miller capacitance $C_c$ 208 is stable over all requisite operating conditions. The worst case operating condition is at high current, when $G_{mMPO}$ is very large. Combined with $A_2$, the unity gain bandwidth of this Miller stage will be $$f_{bwMILLER} = \frac{A_2 \cdot G_{mMPO}}{2\pi \cdot CFILT},$$

which is actually the $f_{p2}$ of the LDO 200. If this bandwidth is greater than other poles existing in this local loop, then this local loop is not stable any more, which will potentially cause the overall LDO 200 to become unstable. Under such undesirable conditions, a peak can appear at frequency $f_{bwMILLER}$ for the open loop gain of the overall LDO 200. Since the LDO 200 includes a variable gain stage ($A_2$) 202, a simple solution is that, at high current, when $G_{mMPO}$ is large enough to push out the pole at CFILT 220, the gain from variable gain stage ($A_2$) 202 can be cut down to prevent the bandwidth from getting too high. Since the pole at the PMOS 206 gate can also be a problem at high load current, a portion of the load current is fed into the buffer 210 to beef up the bias current such that the $G_{mBUF}$ is increased to push the pole at the PMOS 206 gate out further than $f_{bwMILLER}$ at high load current. Specifically, PMOS 214 serves this purpose by mirroring a portion of the load current into the buffer 210 in order to boost its driving capability at high load current conditions.

Because the LDO 200 has a variable gain stage ($A_2$) 202, the Miller capacitance $C_c$ 208 does not need to be very large to ensure a low enough dominant pole at N_AMP node 222. The poles at (Vout) 224, (N_A2) 216 and (N_PG) 226 can all be pushed beyond the unity-gain bandwidth $f_{bwLDO}$, so the ESR 228 of CFILT 220 can be very flexible. Due to limitations associated with stand-by current however, some time MPO 206 can have only 5–10 $\mu$A of bias current at no load. This results in an extremely low $G_{mMPO}$ and a lower second pole frequency. Then a reasonable ESR 228 is necessary to achieve a left hand plane (LHP) zero in order to save the phase shift. This zero however, is not required to be accurately placed as seen below with reference to the following figures.

In view of the foregoing, the gain of non-inversion gain stage ($A_2$) 202 must change in some controlled way. Specifically, when MPO 206 is turned on harder, the gain of ($A_2$) 202 should be lower. One way to accomplish this is to lower the output impedance of non-inversion gain stage ($A_2$) 202 according to MPO's 206 current.

Figure 5:
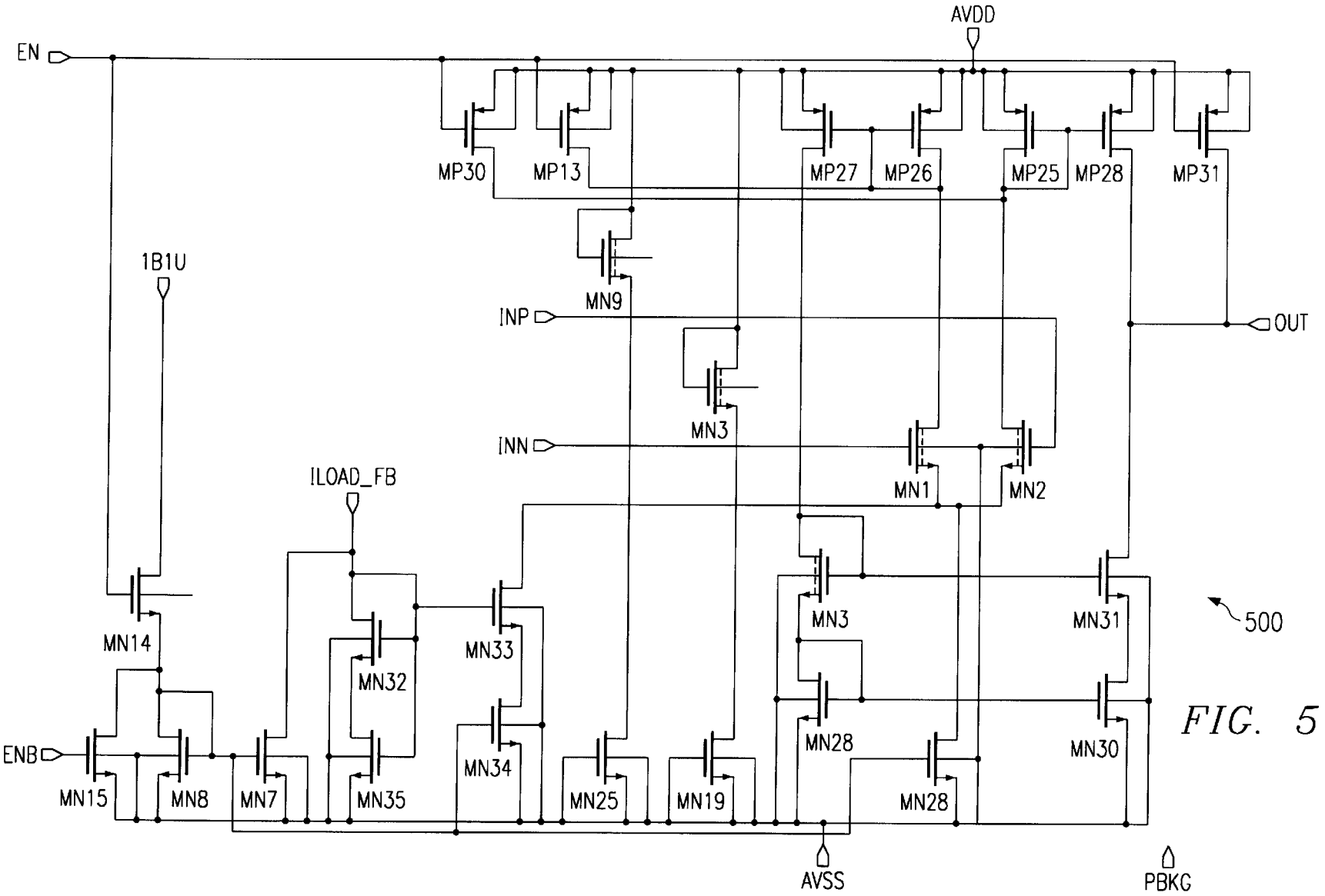
FIG. 5 illustrates a more detailed view of the unity-gain buffer portion of the PMOS LDO shown in FIG. 3.

FIG. 3 is a top level diagram illustrating a PMOS LDO 300 according to one embodiment of the present invention and that was implemented using a traditional analog process and shows a power PMOS 302, a non-inversion variable gain stage 304 and error amplifier stage 306; while FIG. 4 illustrates a more detailed view of the error amplifier stage 306 and the non-inversion variable gain stage 304 of the PMOS LDO 300. The output 308 of the non-inversion variable gain stage 304 is shunted to the positive supply via a 300 k ohm resistor 400 in combination with a pair of diode connected PMOS transistors 402, 404. The gates of the PMOS transistor 402, 404 can also be driven by the gate voltage of MPO 302. Thus, when Vgs of MPO 302 gets larger (indicates larger load current), the shunt PMOS transistors 402, 404 will be on harder so the combined output impedance of non-inversion variable gain stage 304 will be lower (limited by the series 300 k ohm resistor 400. FIG. 5 simply illustrates a more detailed view of the unity-gain buffer 500 used to drive the power MPO 302 of the PMOS LDO 300 shown in FIG. 3.

In summary explanation of the above, at the low current end, where the Gm of the power PMOS (MPO) 206 is minimum, a minimum gain provided by the non-inversion variable gain stage 202 is necessary to drive the second pole ( $$f_{p2} = \frac{A_2 \cdot G_m}{CFILT},$$

unity gain bandwidth of the Miller compensation stage) far enough around or above LDO's 200 unity gain bandwidth. At the high load current end, where Gm of MPO 206 is maximum, the gain provided by the non-inversion variable gain stage 202 must be cut down so that $f_{p2}$ does not move out to a dramatically higher frequency so that the Miller compensation stage retains its single pole characteristic within its unity gain bandwidth. Since the node (N_A2) 216 between the non-inversion variable gain stage 202 and the buffer stage 210 is a mid-frequency pole, $f_{p2}$ can always be made lower than the pole at node (N_A2) 216 by adjusting the gain of variable gain stage 202 over the full load current range. Cutting down the output impedance of variable gain stage 202, as discussed above, provides multiple benefits. It both lowers the gain of variable gain stage 202 and drives the pole at node (N_A2) 216 further. The idea is to reduce the gain of gain stage 202 in order to compensate for the increased Gm of MPO 206.

Figure 6:
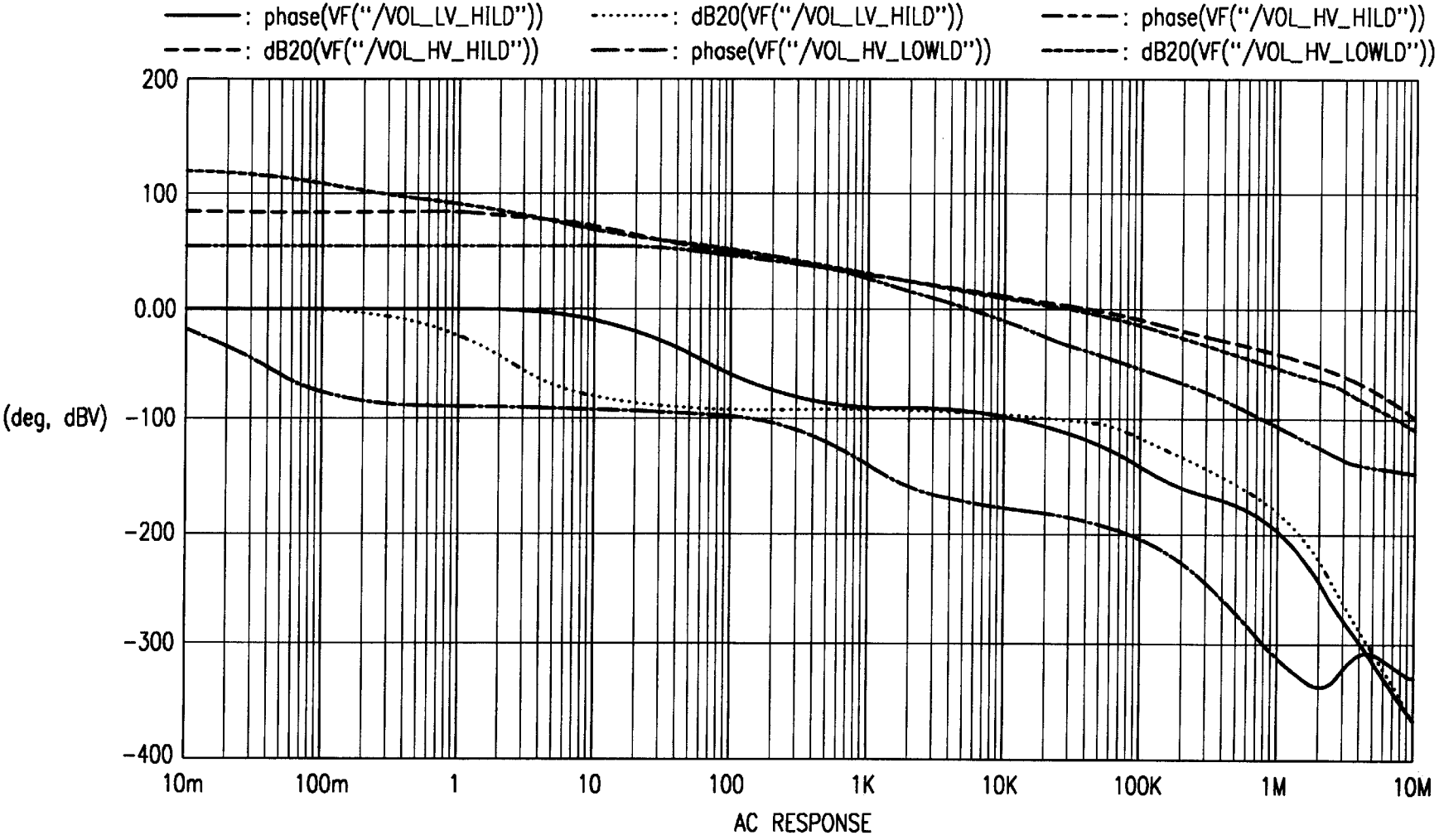
FIG. 6 illustrates an AC response simulation of open loop gain with 50 m ohm ESR and 4.7 $\mu$F CFILT for the PMOS LDO shown in FIG. 3.
Figure 7:
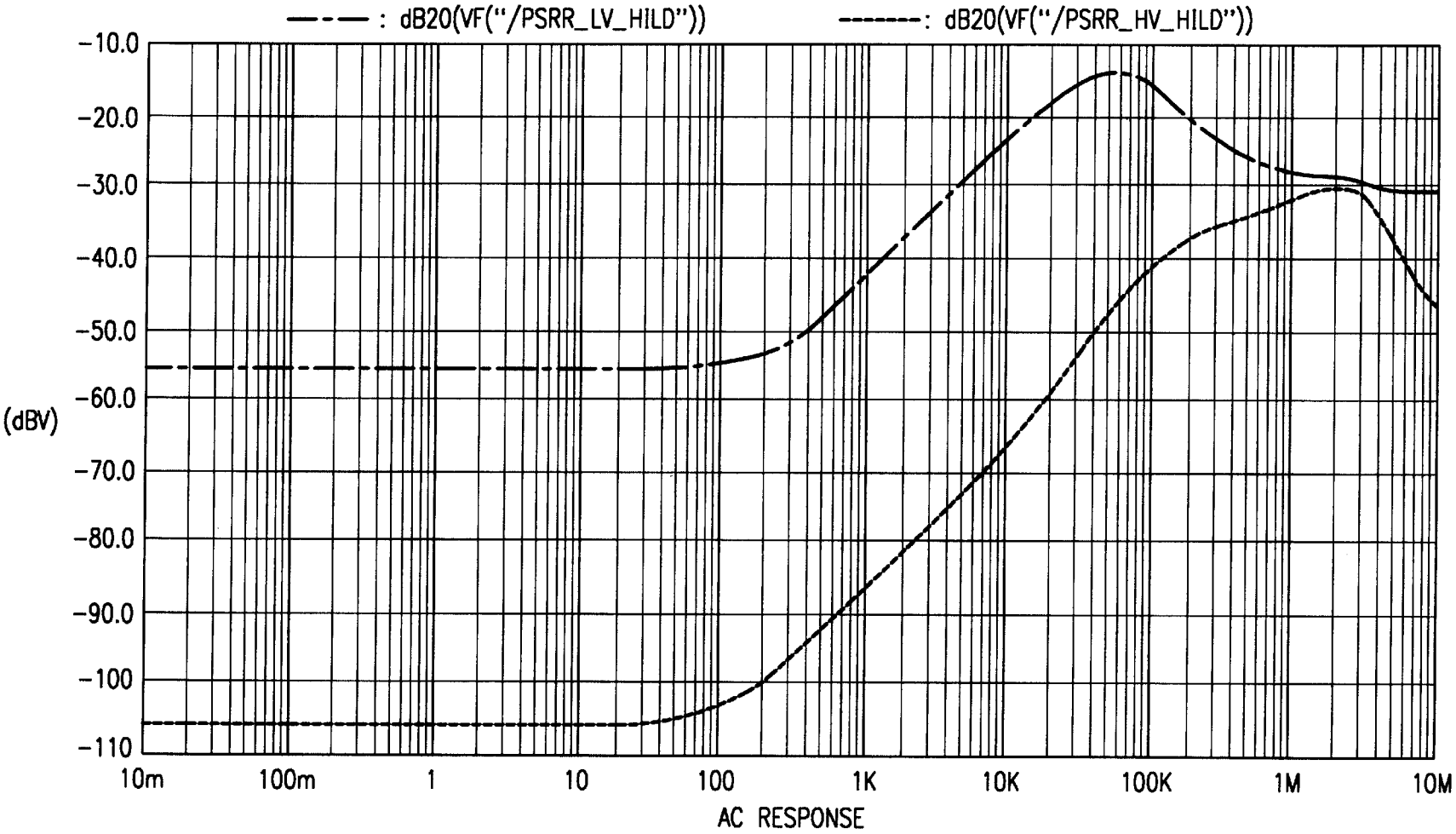
FIG. 7 illustrates an AC response simulation of PSRR with 50 m ohm ESR and 4.7 $\mu$F CFILT for the PMOS LDO shown in FIG. 3.
Figure 8:
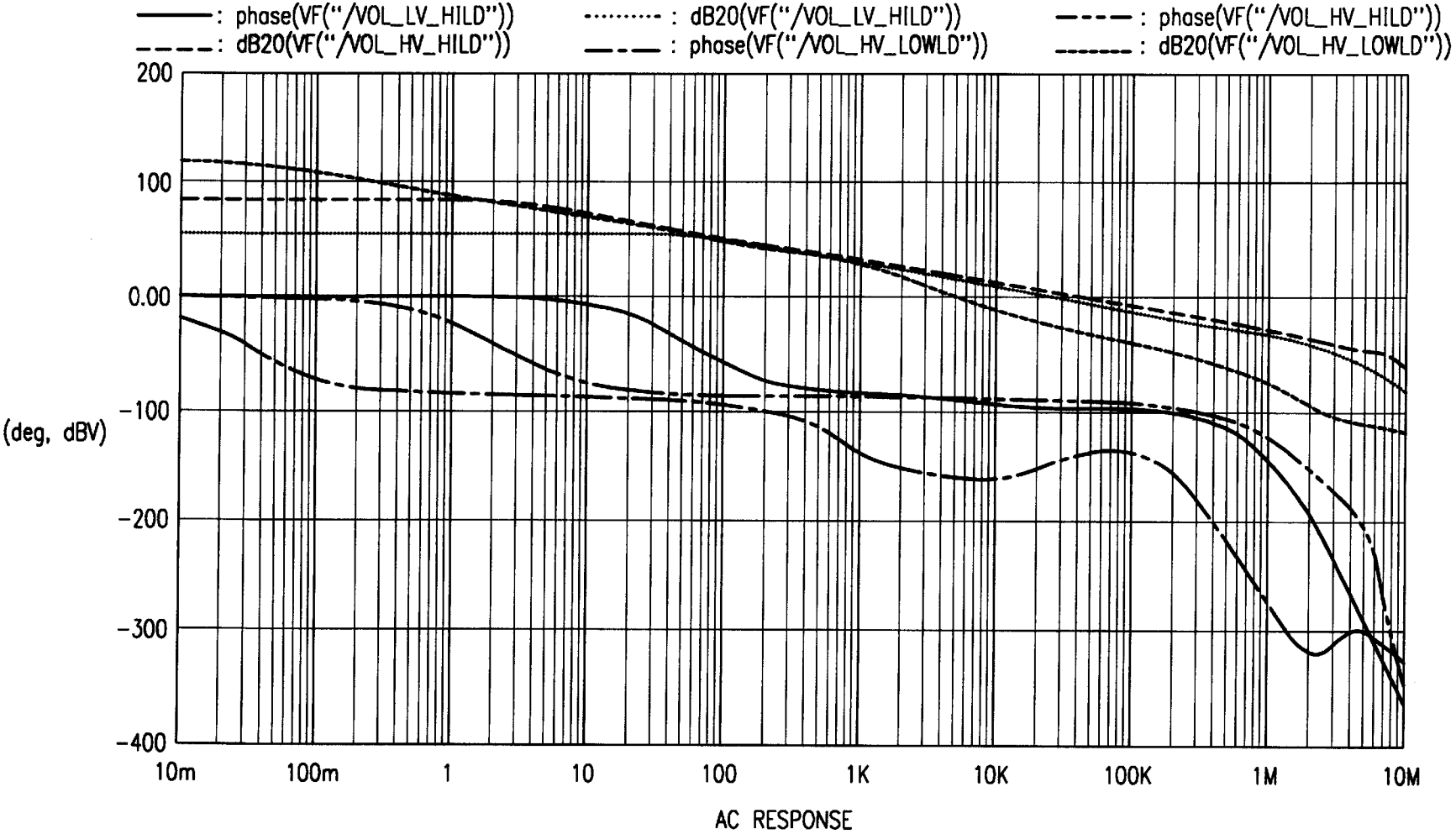
FIG. 8 illustrates an AC response simulation of open loop gain with 1 ohm ESR and 4.7 $\mu$F CFILT for the PMOS LDO shown in FIG. 3.
Figure 9:
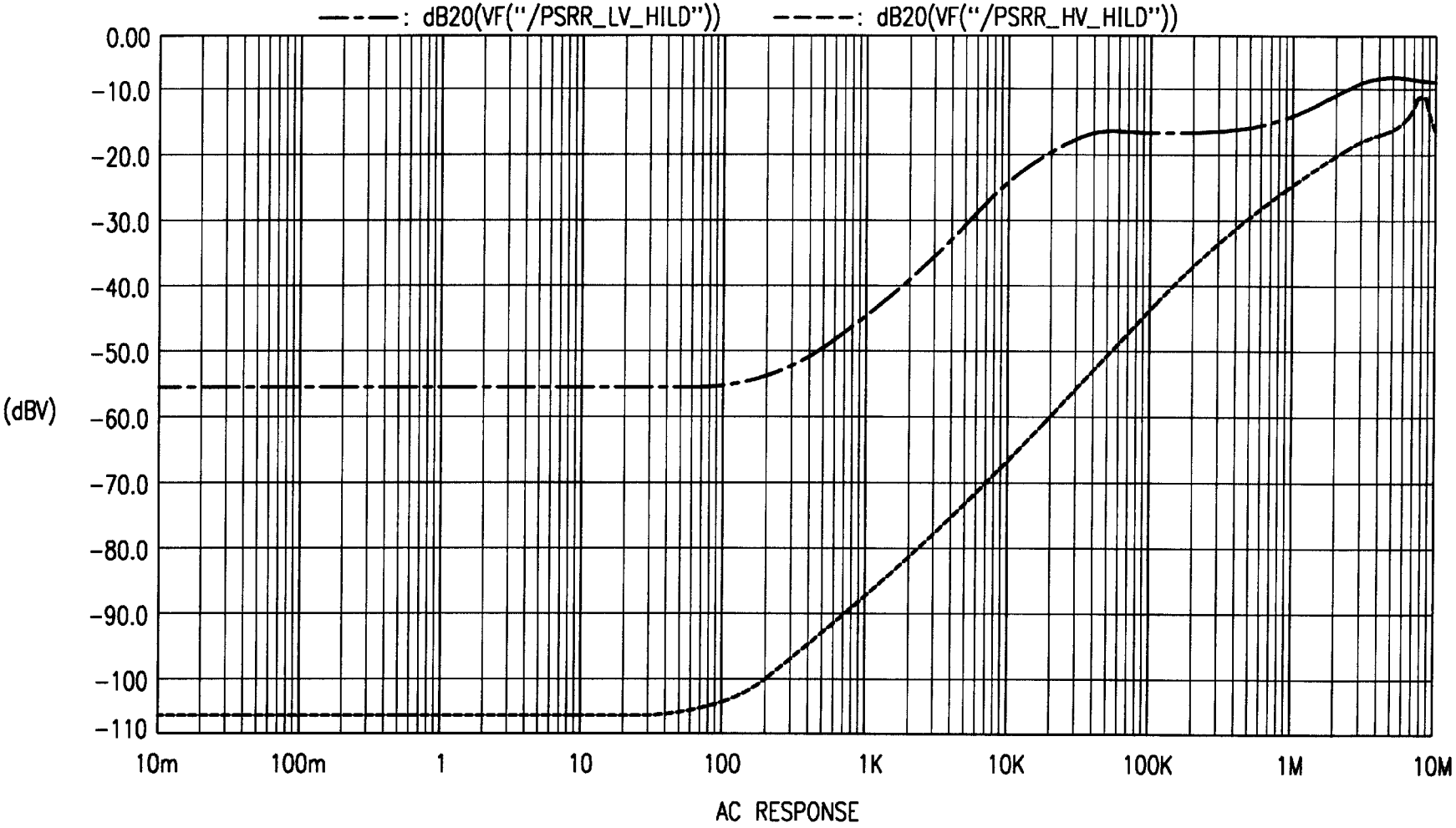
FIG. 9 illustrates an AC response simulation of PSRR with 1 ohm ESR and 4.7 $\mu$F CFILT for the PMOS LDO shown in FIG. 3.

FIGS. 6–9 illustrate curve sets for high-Vdd-no-load, high-Vdd-high-load, and low-Vdd-high-load conditions respectively wherein FIG. 6 illustrates an AC response simulation of open loop gain with 50 m ohm ESR and 4.7 $\mu$F CFILT for the PMOS LDO 300 shown in FIG. 3; FIG. 7 illustrates an AC response simulation of PSRR with 50 m ohm ESR and 4.7 $\mu$F CFILT for the PMOS LDO 300 shown in FIG. 3; FIG. 8 illustrates an AC response simulation of open loop gain with 1 ohm ESR and 4.7 $\mu$F CFILT for the PMOS LDO 300 shown in FIG. 3; and FIG. 9 illustrates an AC response simulation of PSRR with 1 ohm ESR and 4.7 $\mu$F CFILT for the PMOS LDO 300 shown in FIG. 3.

Figure 10:
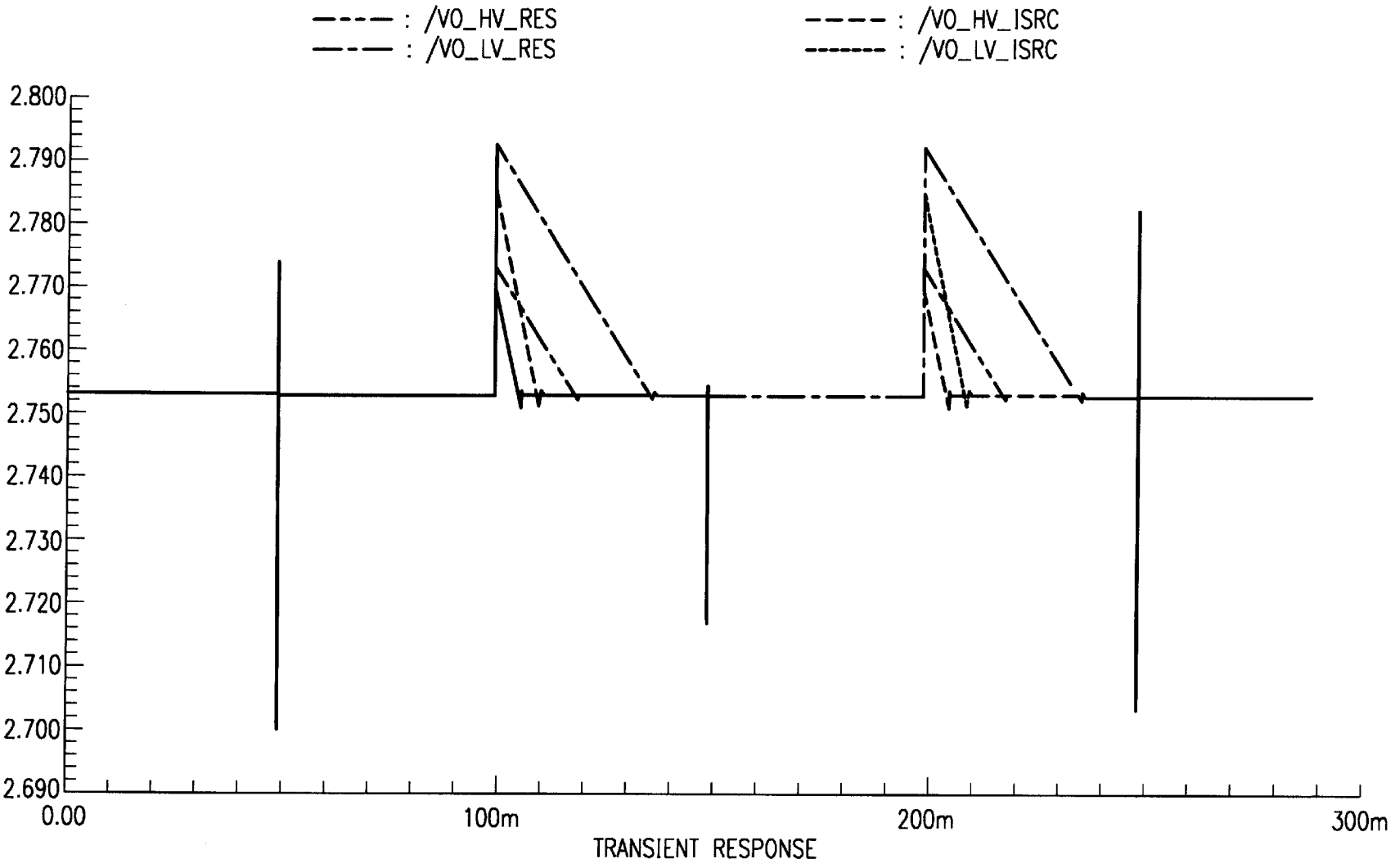
FIG. 10 illustrates a transient response simulation of switching between no load and maximum load conditions with 50 m ohm ESR and 4.7 μF CFILT for the PMOS LDO shown in FIG. 3.
Figure 11:
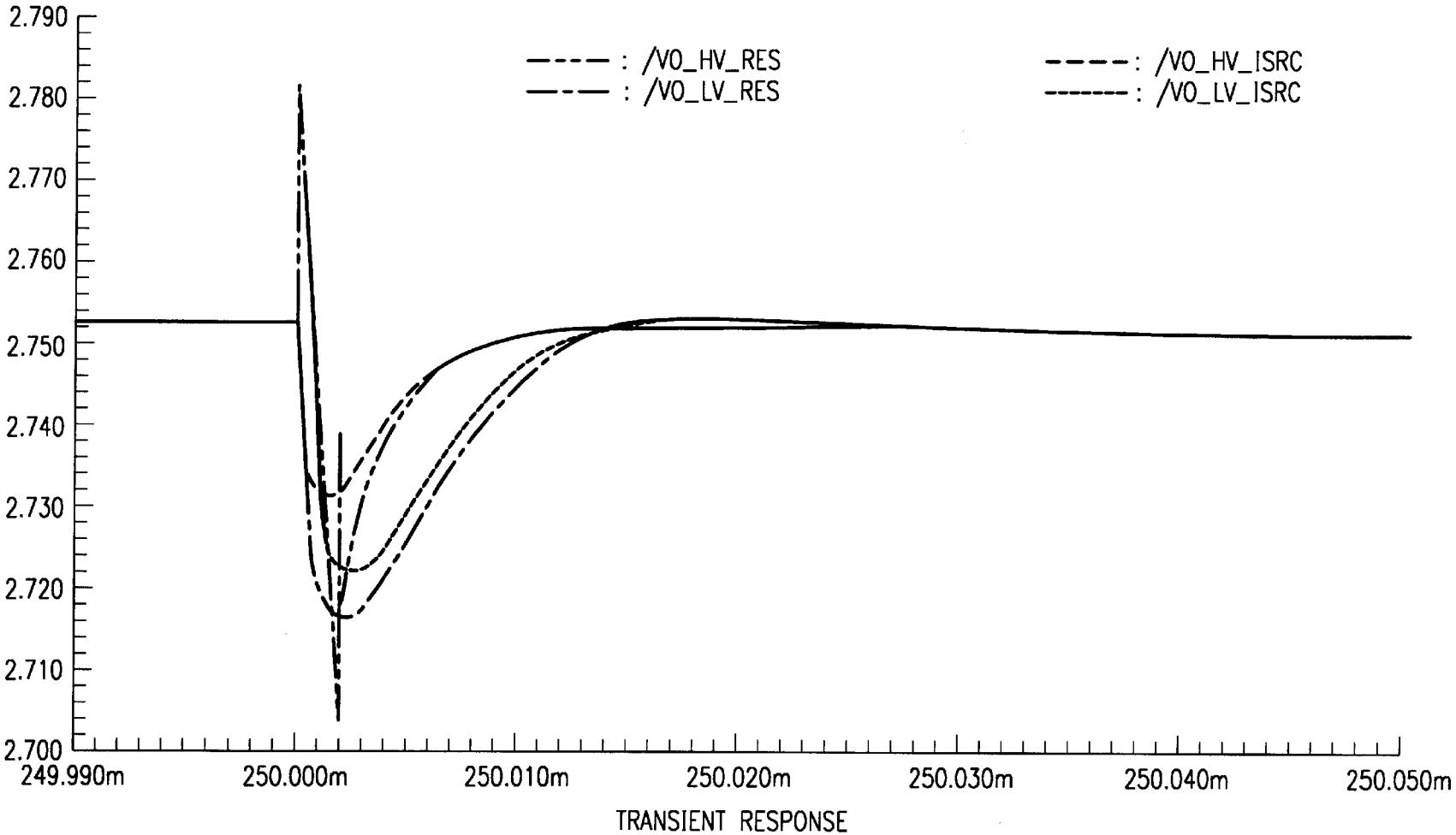
FIG. 11 illustrates a transient response simulation when switching from no load to maximum load conditions with 50 m ohm ESR and 4.7 μF CFILT for the PMOS LDO shown in FIG. 3.
Figure 12:
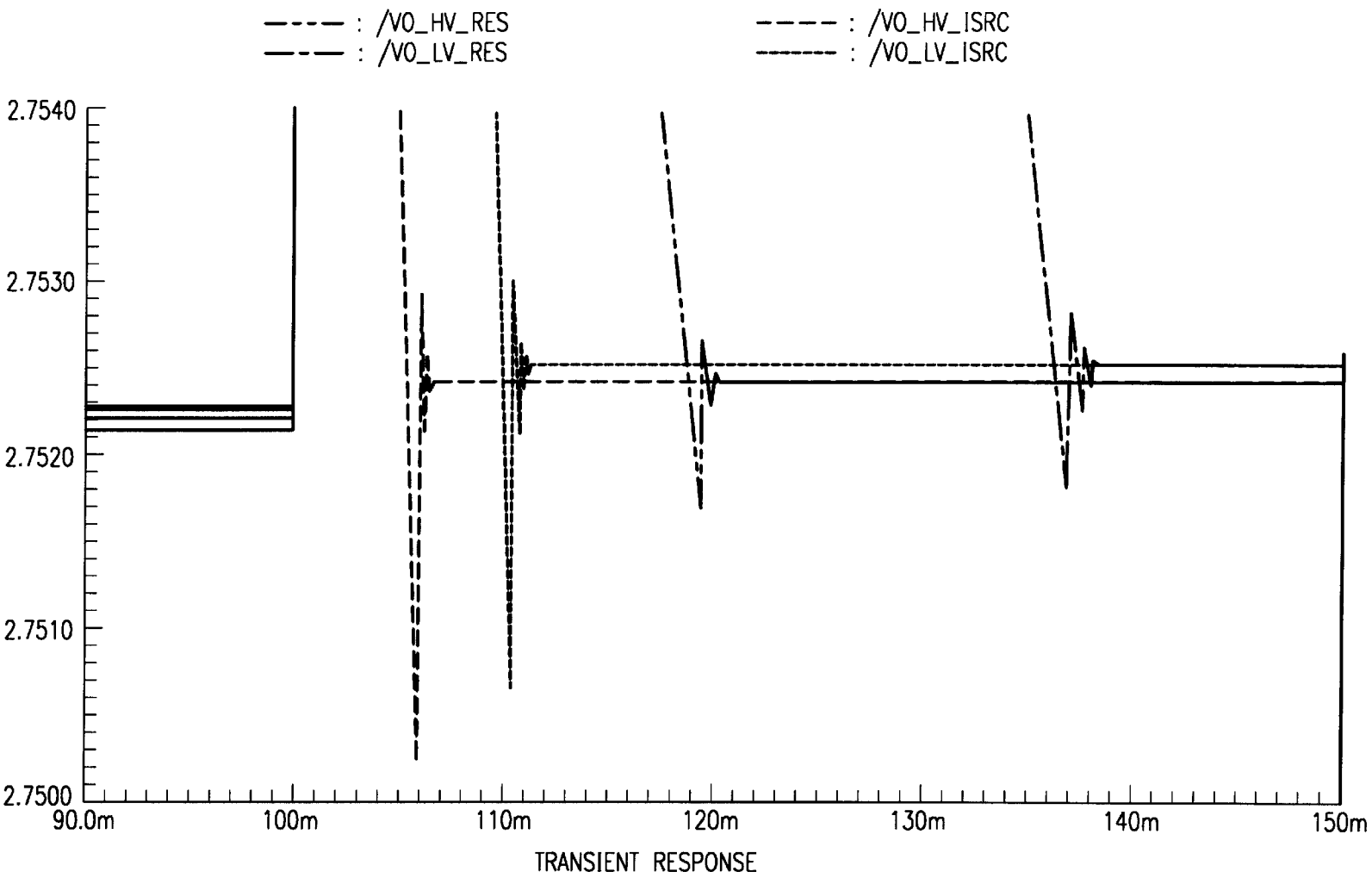
FIG. 12 illustrates a transient response simulation when switching from maximum load to no load conditions with 50 m ohm ESR and 4.7 μF CFILT for the PMOS LDO shown in FIG. 3.
Figure 13:
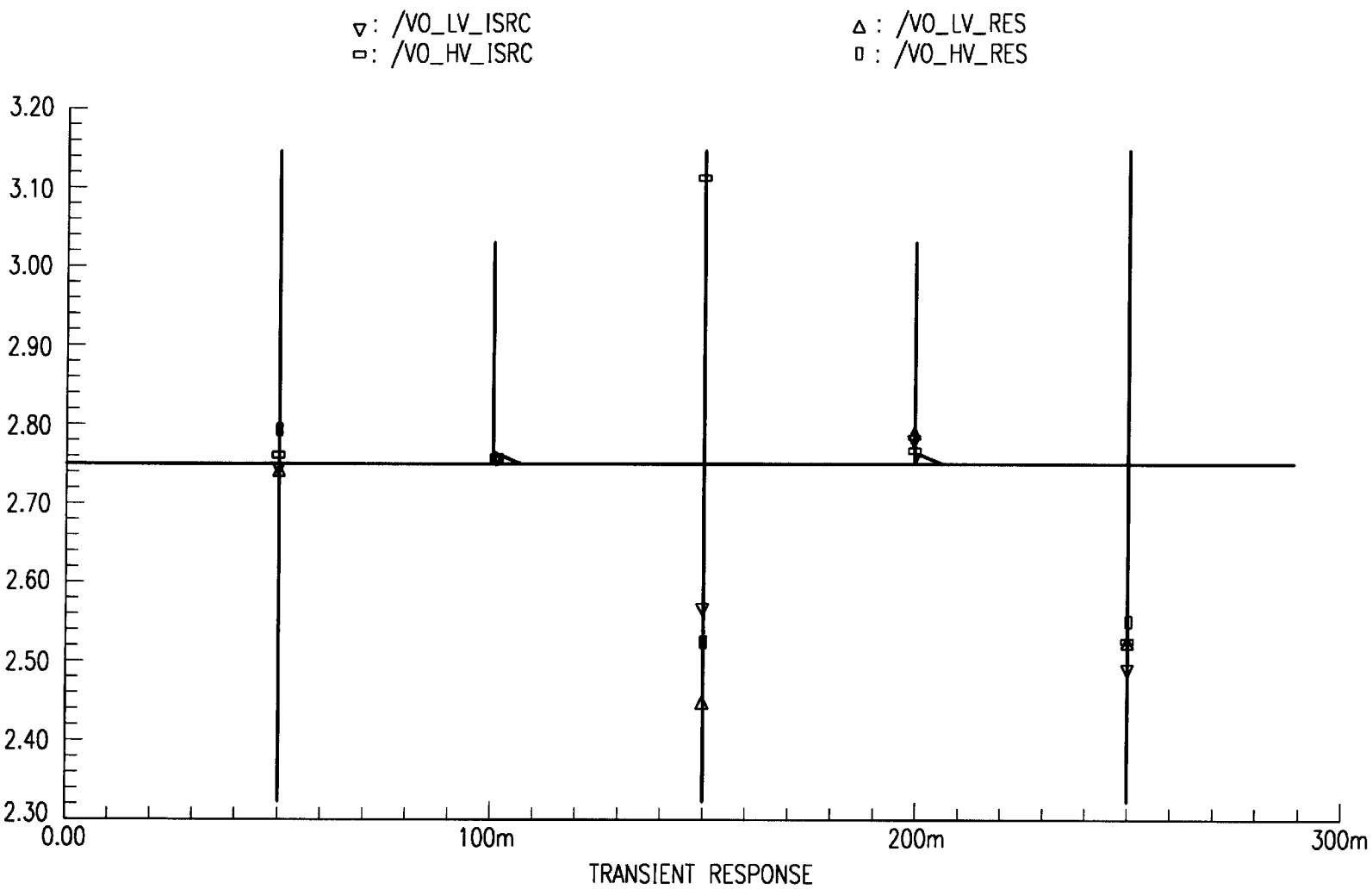
FIG. 13 illustrates a transient response simulation of switching between no load and maximum load conditions with 2 ohm ESR and 4.7 μF CFILT for the PMOS LDO shown in FIG. 3.
Figure 14:
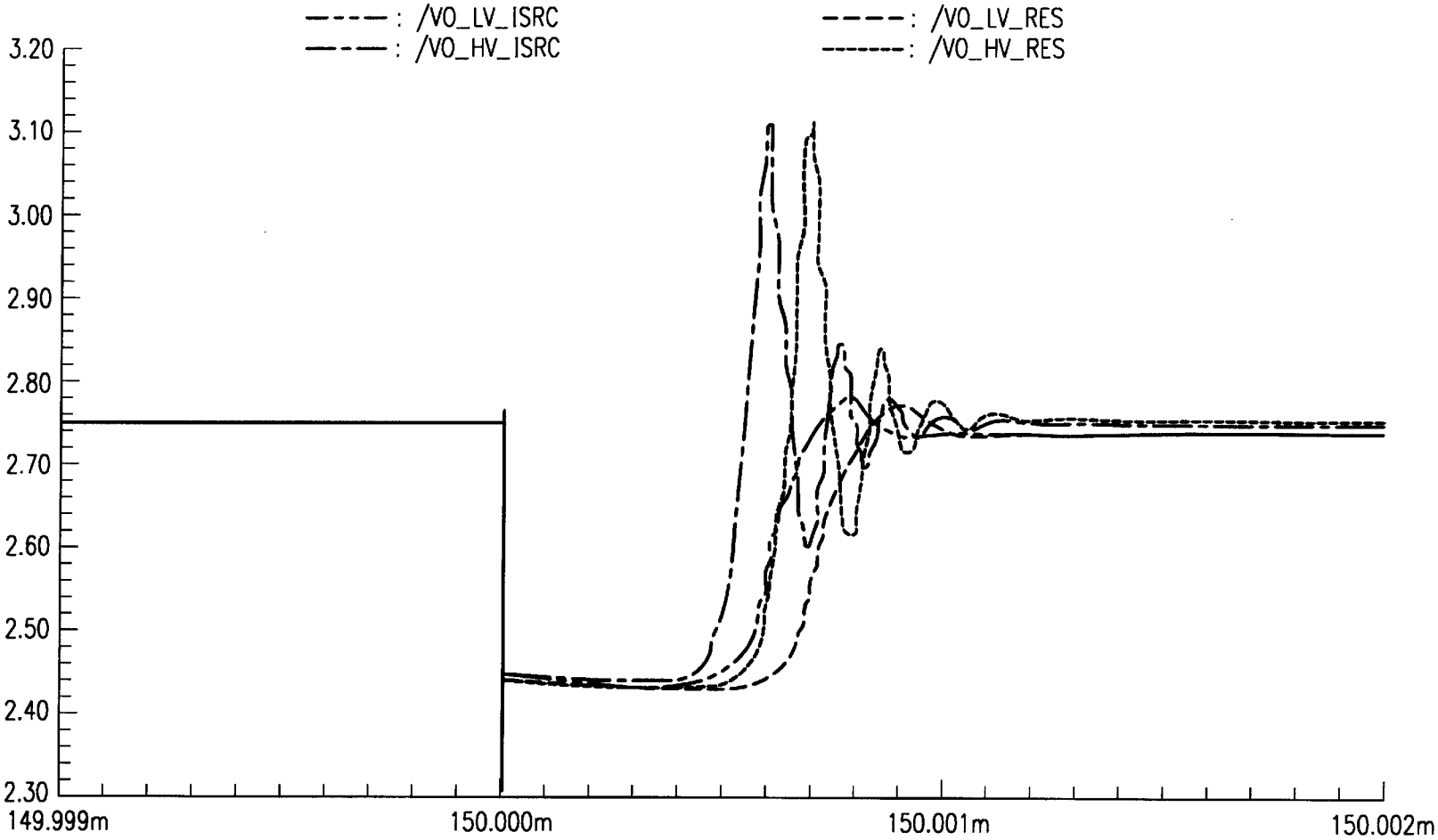
FIG. 14 illustrates a transient response simulation when switching from no load to maximum load conditions with 2 ohm ESR and 4.7 μF CFILT for the PMOS LDO shown in FIG. 3.
Figure 15:
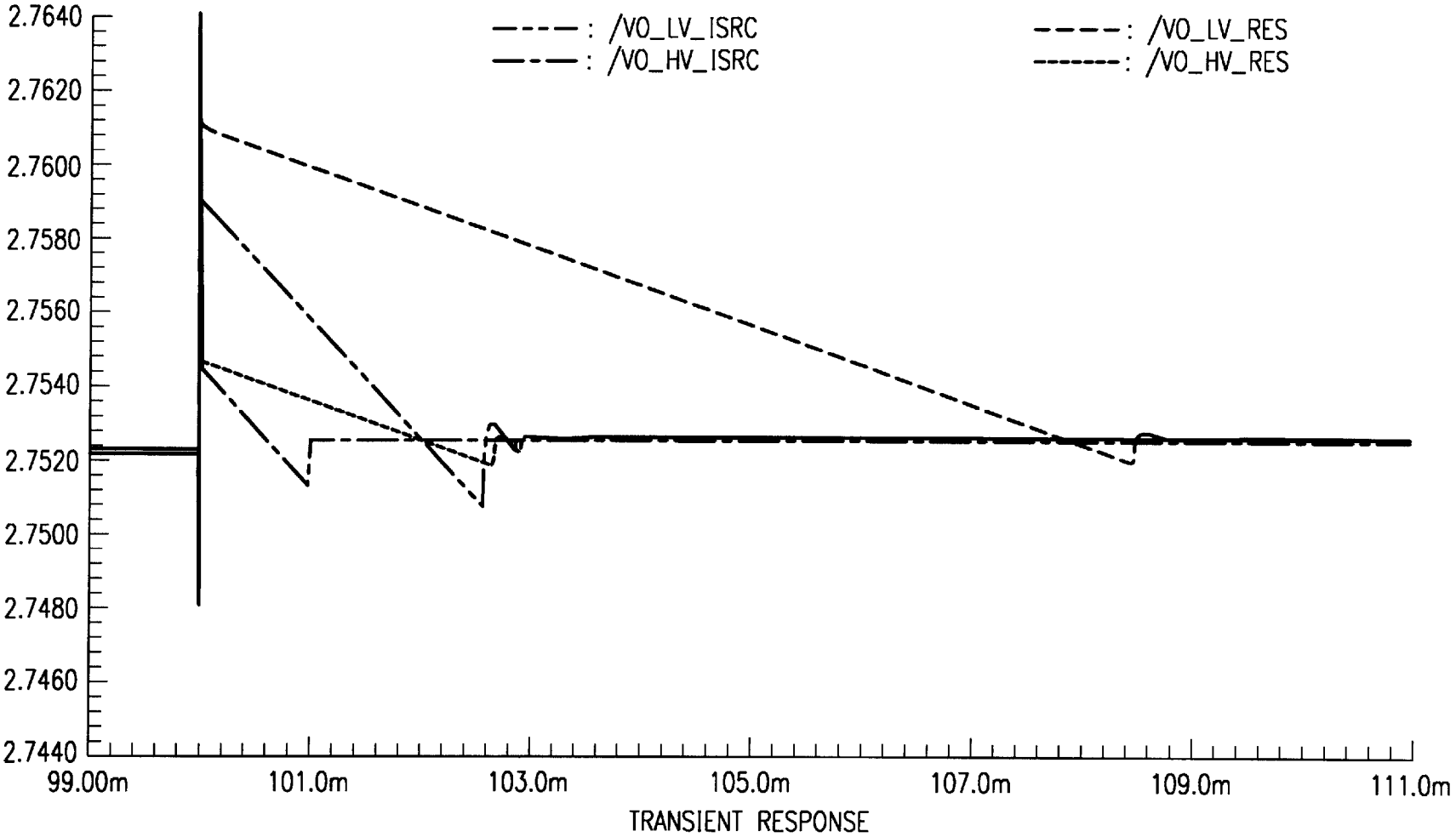
FIG. 15 illustrates a transient response simulation when switching from maximum load to no load conditions with 2 ohm ESR and 4.7 μF CFILT for the PMOS LDO shown in FIG. 3.

FIGS. 10–15 illustrate load regulation curve sets for high/low Vdd and resistive load/current source load, simulated with a simple 5nH+50 m ohm bonding wire model and a 1 nsec rise/fall time wherein FIG. 10 illustrates a transient response simulation of no load and maximum load conditions with 50 m ohm ESR and 4.7 μF CFILT for the PMOS LDO 300 shown in FIG. 3; FIG. 11 illustrates a transient response simulation when switching from no load to maximum load conditions with 50 m ohm ESR and 4.7 μF CFILT for the PMOS LDO 300 shown in FIG. 3; FIG. 12 illustrates a transient response simulation when switching from maximum load to no load conditions with 50 m ohm ESR and 4.7 μF CFILT for the PMOS LDO 300 shown in FIG. 3; FIG. 13 illustrates a transient response simulation of no load and maximum load conditions with 2 ohm ESR and 4.7 μF CFILT for the PMOS LDO 300 shown in FIG. 3; FIG. 14 illustrates a transient response simulation when switching from no load to maximum load conditions with 2 ohm ESR and 4.7 μF CFILT for the PMOS LDO 300 shown in FIG. 3; and FIG. 15 illustrates a transient response simulation when switching from maximum load to no load conditions with 2 ohm ESR and 4.7 μF CFILT for the PMOS LDO 300 shown in FIG. 3.

Figure 16:
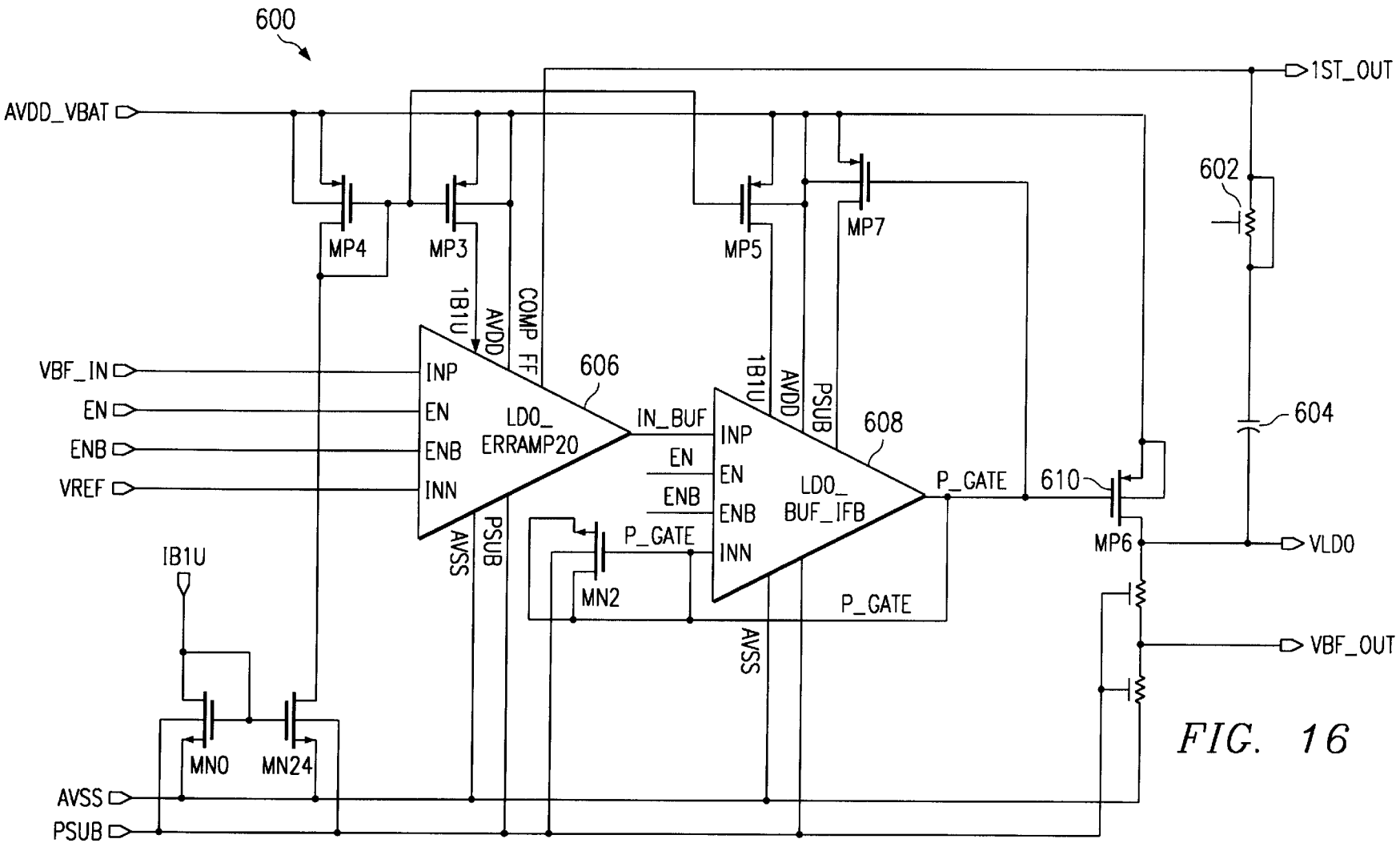

FIG. 16 is a top level schematic diagram illustrating a PMOS LDO 600 recently commercialized using 1533c035 advanced digital process techniques by Texas Instruments Incorporated of Dallas, Tex., according to one embodiment of the present invention. The LDO includes an error amplifier and non-inversion gain stage shown in element 606 as well as a rail-to-rail buffer shown in element 608 to drive the power PMOS 610. The LDO 600 ratings are: Vin from 2V to 3.6V, Vout=1.8V, $C_c$=60 pF, CFILT=1 μF, stand-by current=40 μA and max load current=50 mA. A 10 k ohm resistor 602 in series with the Miller capacitor 604 can be seen to be shorted; though it could be used to add a LHP zero at 260 kHz to save the phase shift a little for no load current. The present inventor believes however, that it might lift up the gain curve for high load current and actually degrade the circuit stability such as discussed herein before.

Figure 17:
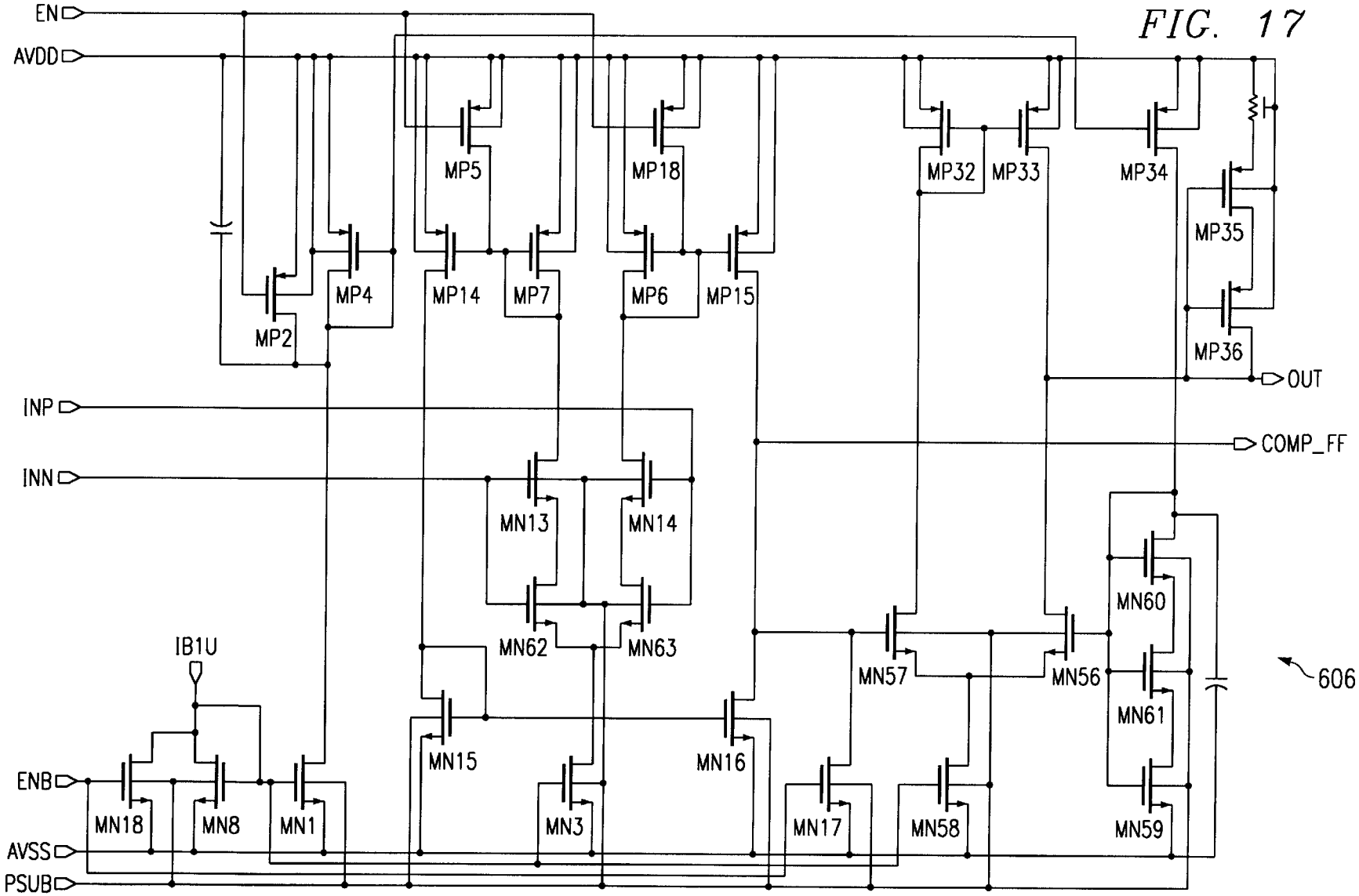
FIG. 17 illustrates a more detailed view of the error amplifier stage and the non-inversion gain stage of the PMOS LDO shown in FIG. 16.
Figure 18:
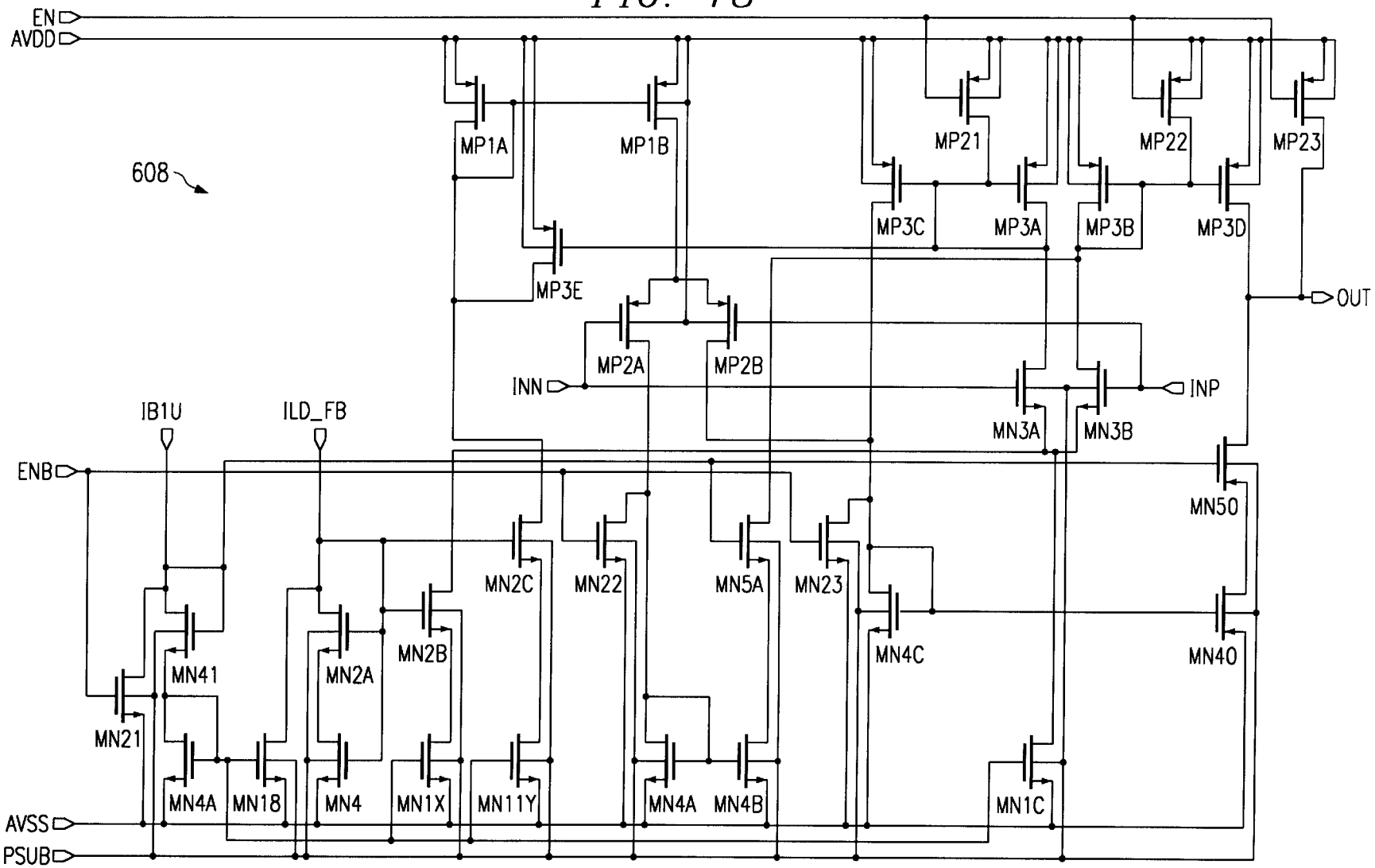
FIG. 18 illustrates a more detailed view of the rail-to-rail buffer portion of the PMOS LDO shown in FIG. 16.

FIG. 17 illustrates a more detailed view of element 606 showing the error amplifier stage and the non-inversion gain stage of the PMOS LDO 600 shown in FIG. 16; while FIG. 18 illustrates a more detailed view of the rail-to-rail buffer 608 portion of the PMOS LDO 600 shown in FIG. 16.

Figure 19:
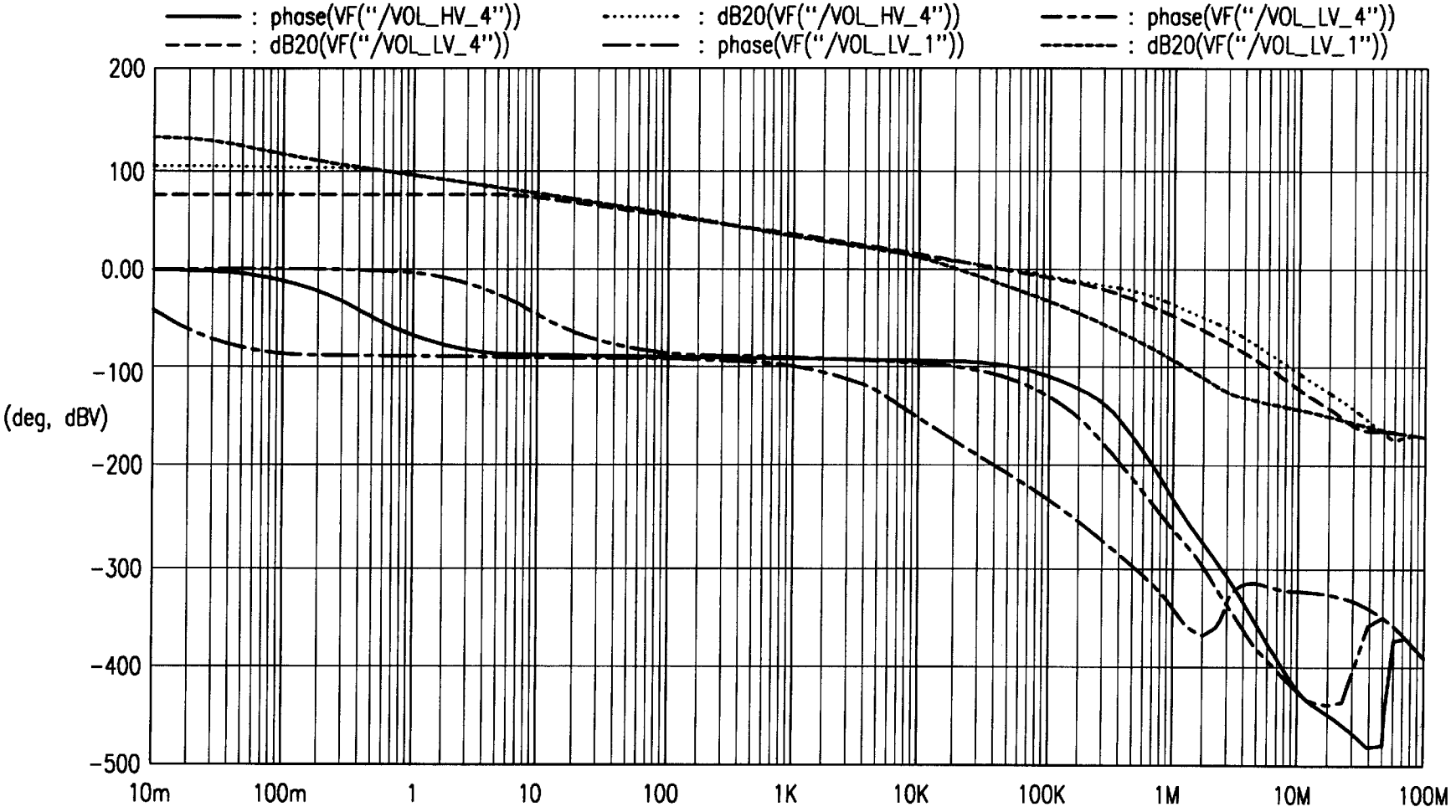
FIG. 19 illustrates an AC response simulation of open loop gain with 50 m ohm ESR and 1 μF CFILT for the PMOS LDO shown in FIG. 16.
Figure 20:
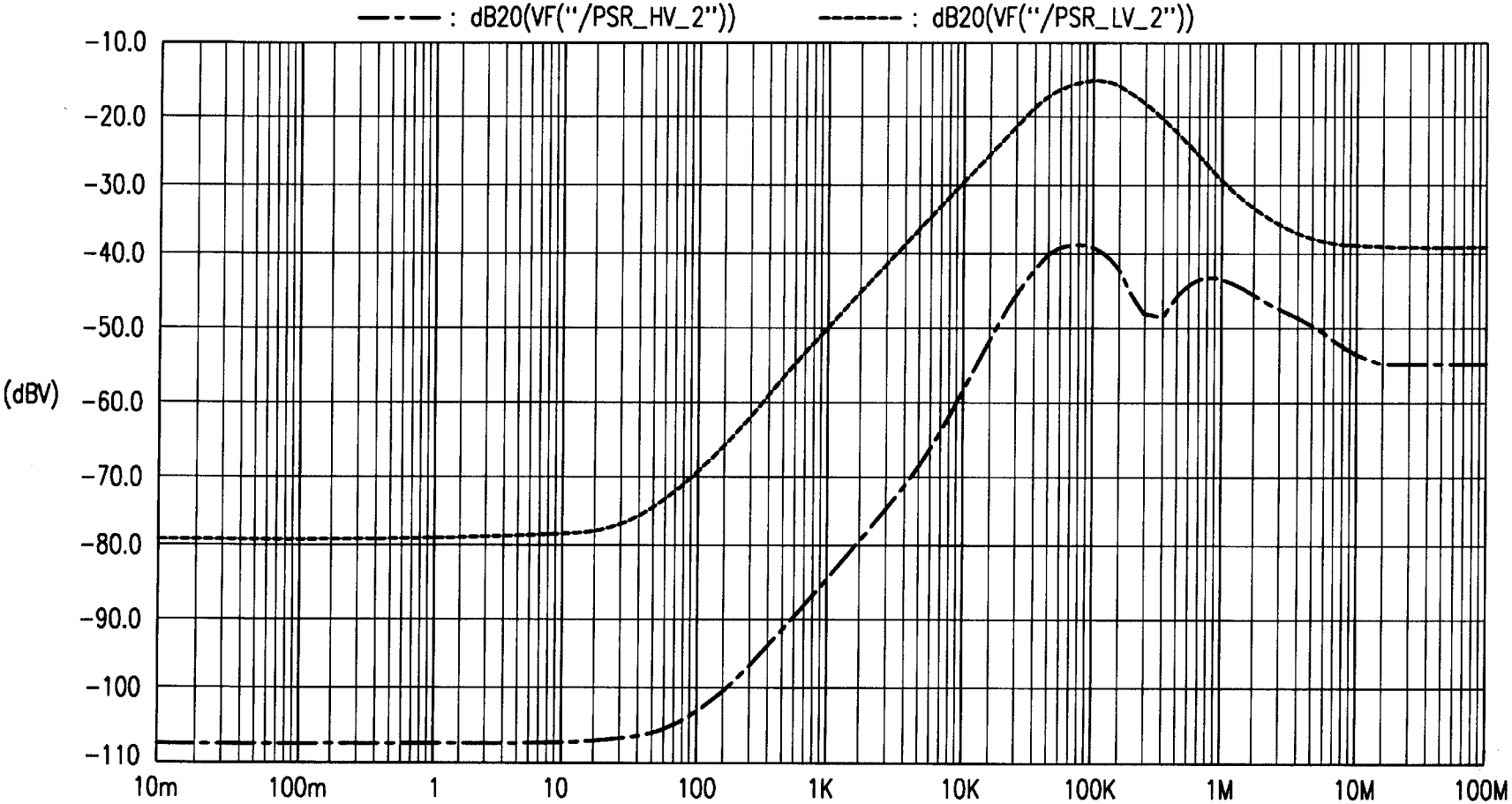
FIG. 20 illustrates an AC response simulation of PSRR with 50 m ohm ESR and 1 μF CFILT for the PMOS LDO shown in FIG. 16.
Figure 21:
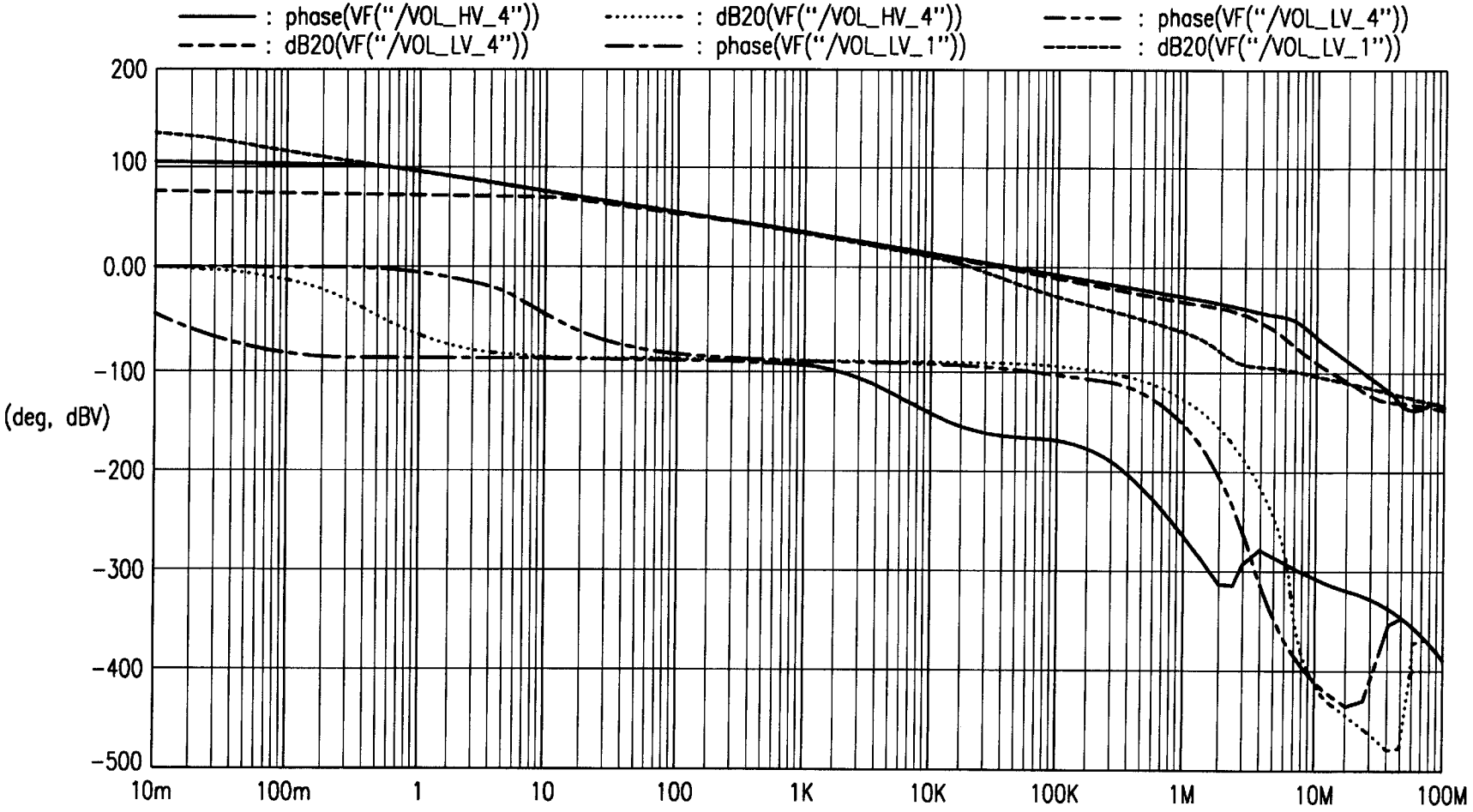
FIG. 21 illustrates an AC response simulation of open loop gain with 2 ohm ESR and 1 μF CFILT for the PMOS LDO shown in FIG. 16.
Figure 22:
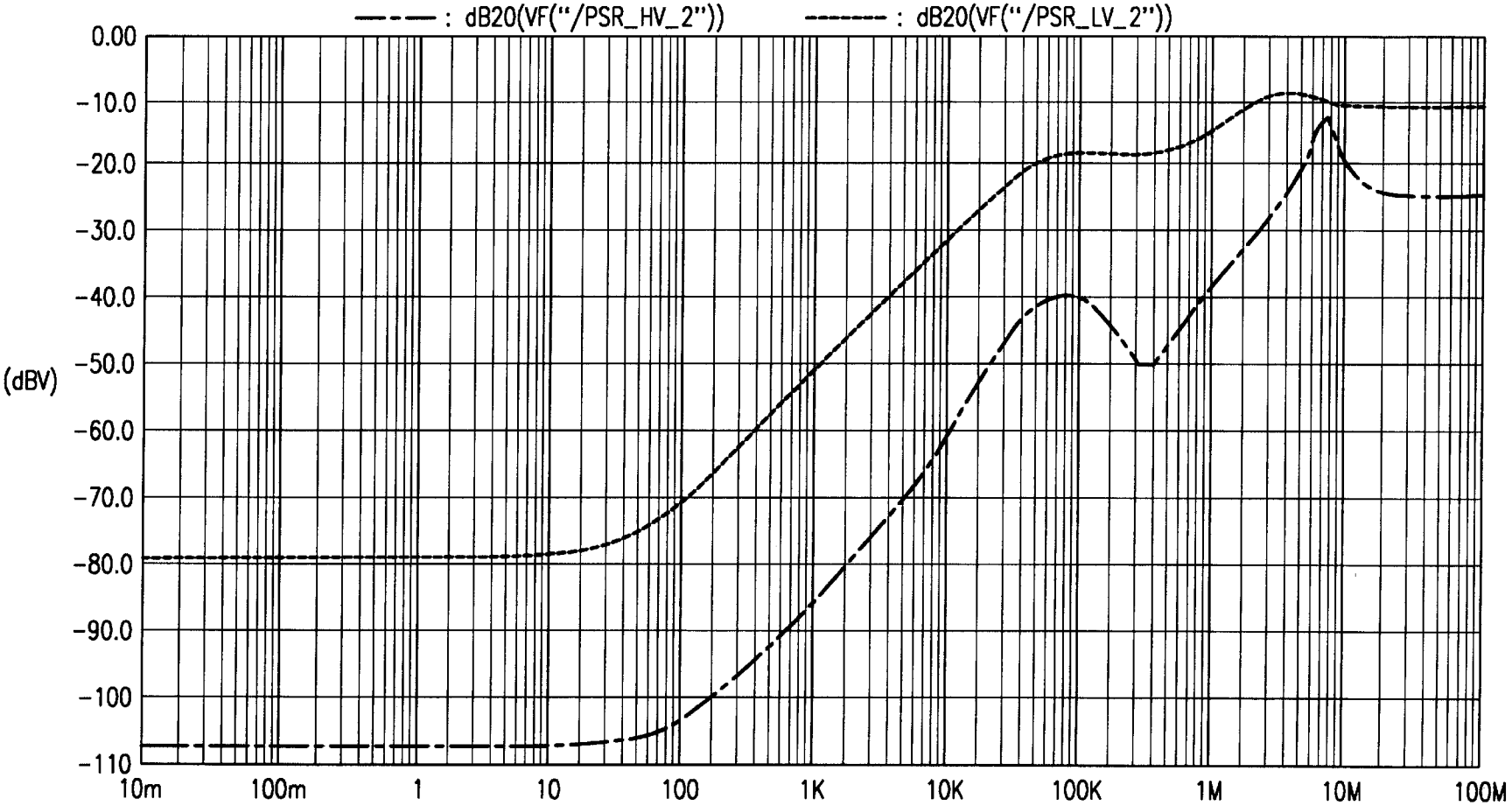
FIG. 22 illustrates an AC response simulation of PSRR with 2 ohm ESR and 1 μF CFILT for the PMOS LDO shown in FIG. 16.

FIGS. 19–22 illustrate curve sets for AC simulations done with 50 m ohm ESR and 1 ohm ESR respectively, wherein FIG. 19 illustrates an AC response simulation of open loop gain with 50 m ohm ESR and 1 μF CFILT for the PMOS LDO 600 shown in FIG. 16; FIG. 20 illustrates an AC response simulation of PSRR with 50 m ohm ESR and 1 μF CFILT for the PMOS LDO 600 shown in FIG. 16; FIG. 21 illustrates an AC response simulation of open loop gain with 2 ohm ESR and 1 μF CFILT for the PMOS LDO 600 shown in FIG. 16; and FIG. 22 illustrates an AC response simulation of PSRR with 2 ohm ESR and 1 μF CFILT for the PMOS LDO 600 shown in FIG. 16.

Figure 23:
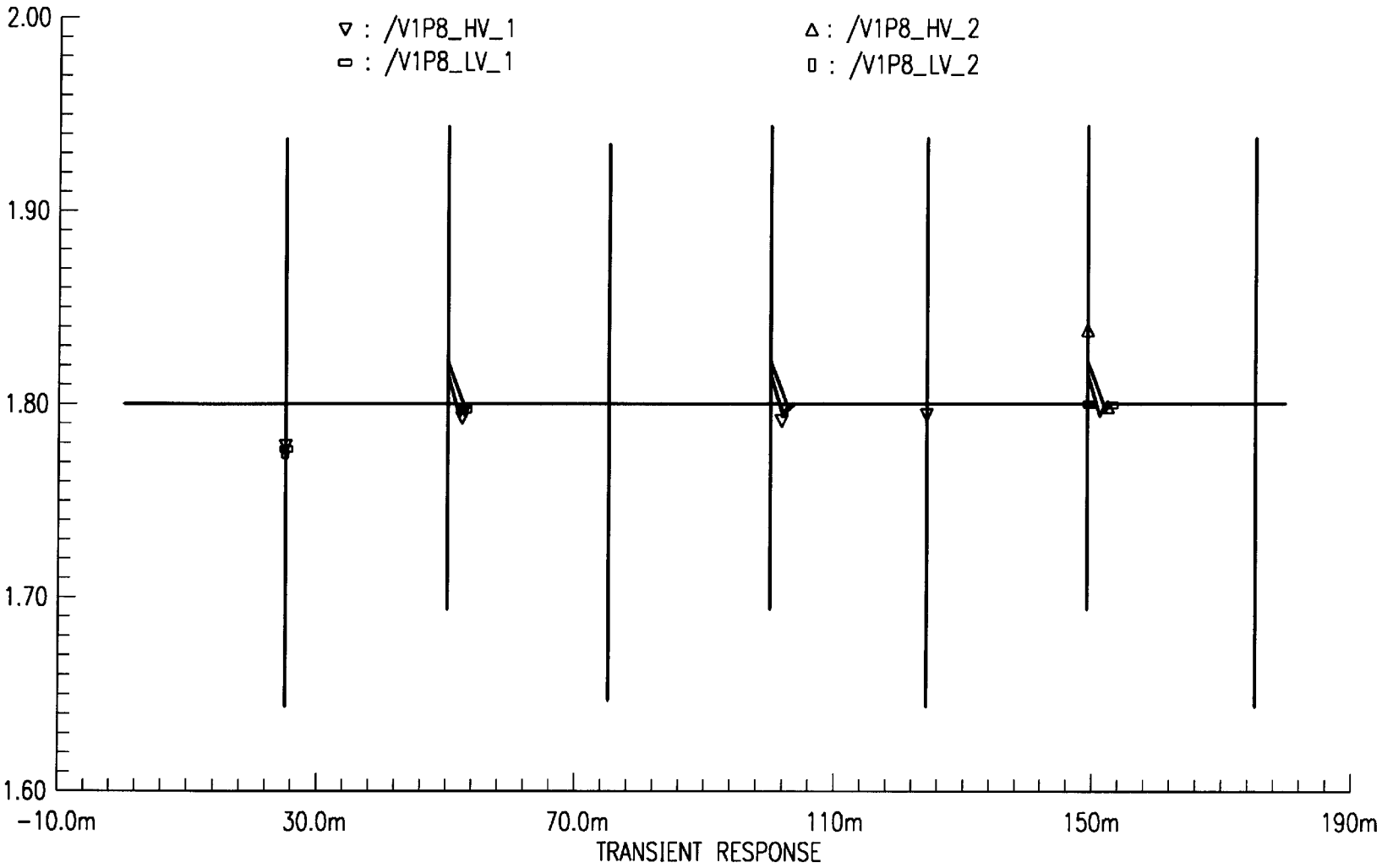
FIG. 23 illustrates a transient response simulation of switching between no load and maximum load conditions with 50 m ohm ESR and 1 μF CFILT for the PMOS LDO shown in FIG. 16.
Figure 24:
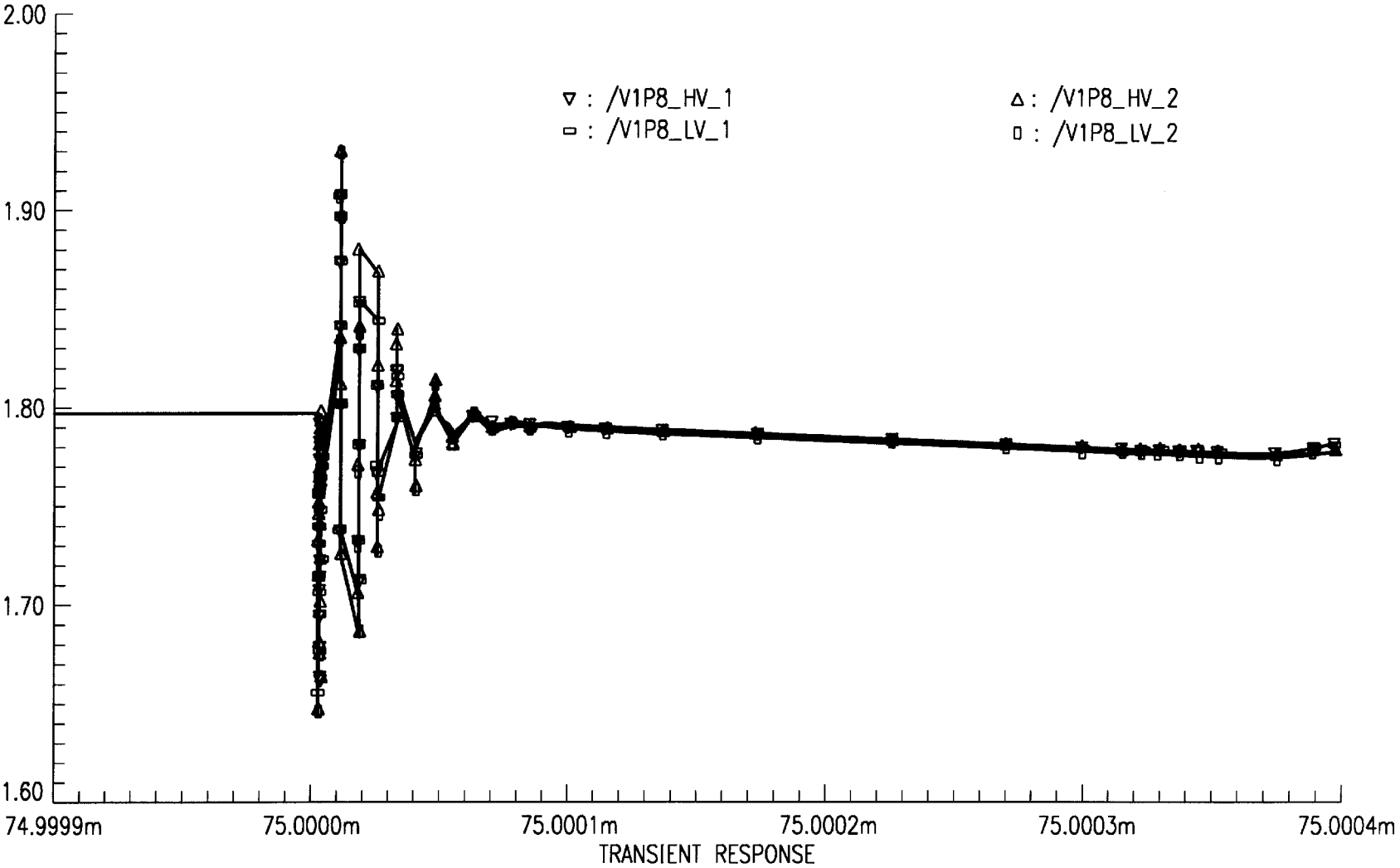
FIG. 24 illustrates a transient response simulation when switching from no load to maximum load conditions with 50 m ohm ESR and 1 μF CFILT for the PMOS LDO shown in FIG. 16.
Figure 25:
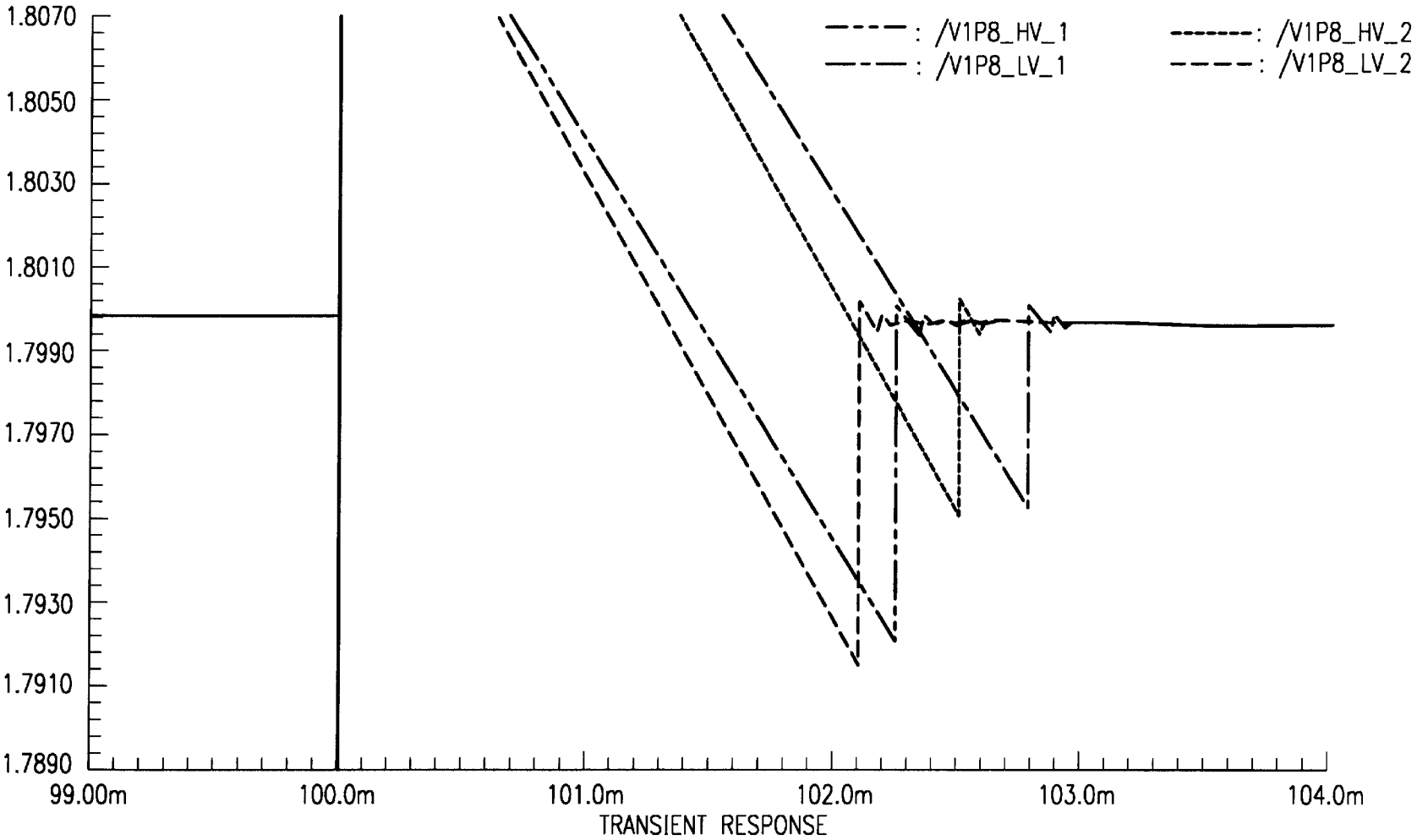
FIG. 25 illustrates a transient response simulation when switching from maximum load to no load conditions with 50 m ohm ESR and 1 μF CFILT for the PMOS LDO shown in FIG. 16.
Figure 26:
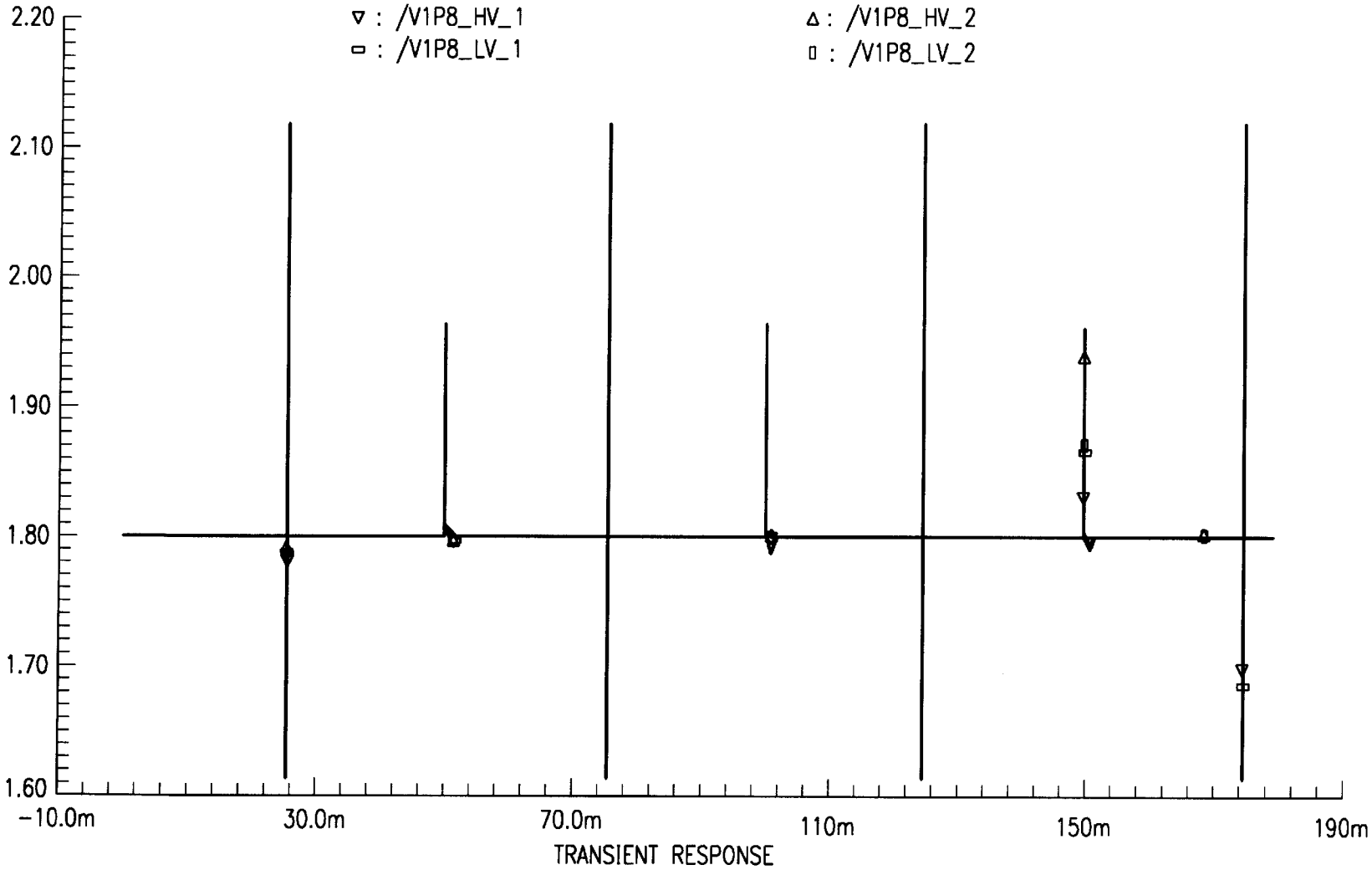
FIG. 26 illustrates a transient response simulation of switching between no load and maximum load conditions with 2 ohm ESR and 1 μF CFILT for the PMOS LDO shown in FIG. 16.
Figure 27:
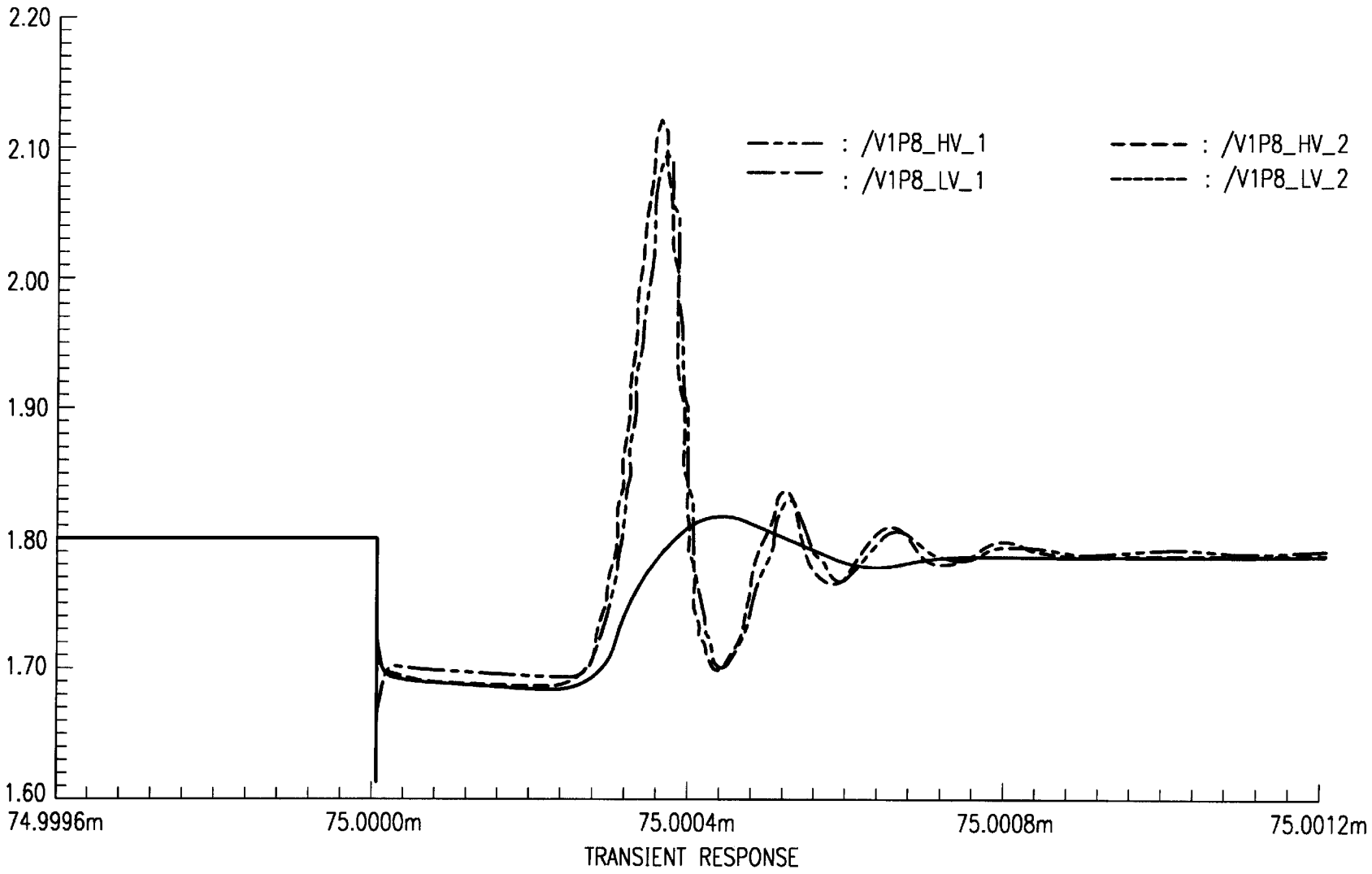
FIG. 27 illustrates a transient response simulation when switching from no load to maximum load conditions with 2 ohm ESR and 1 μF CFILT for the PMOS LDO shown in FIG. 16.
Figure 28:
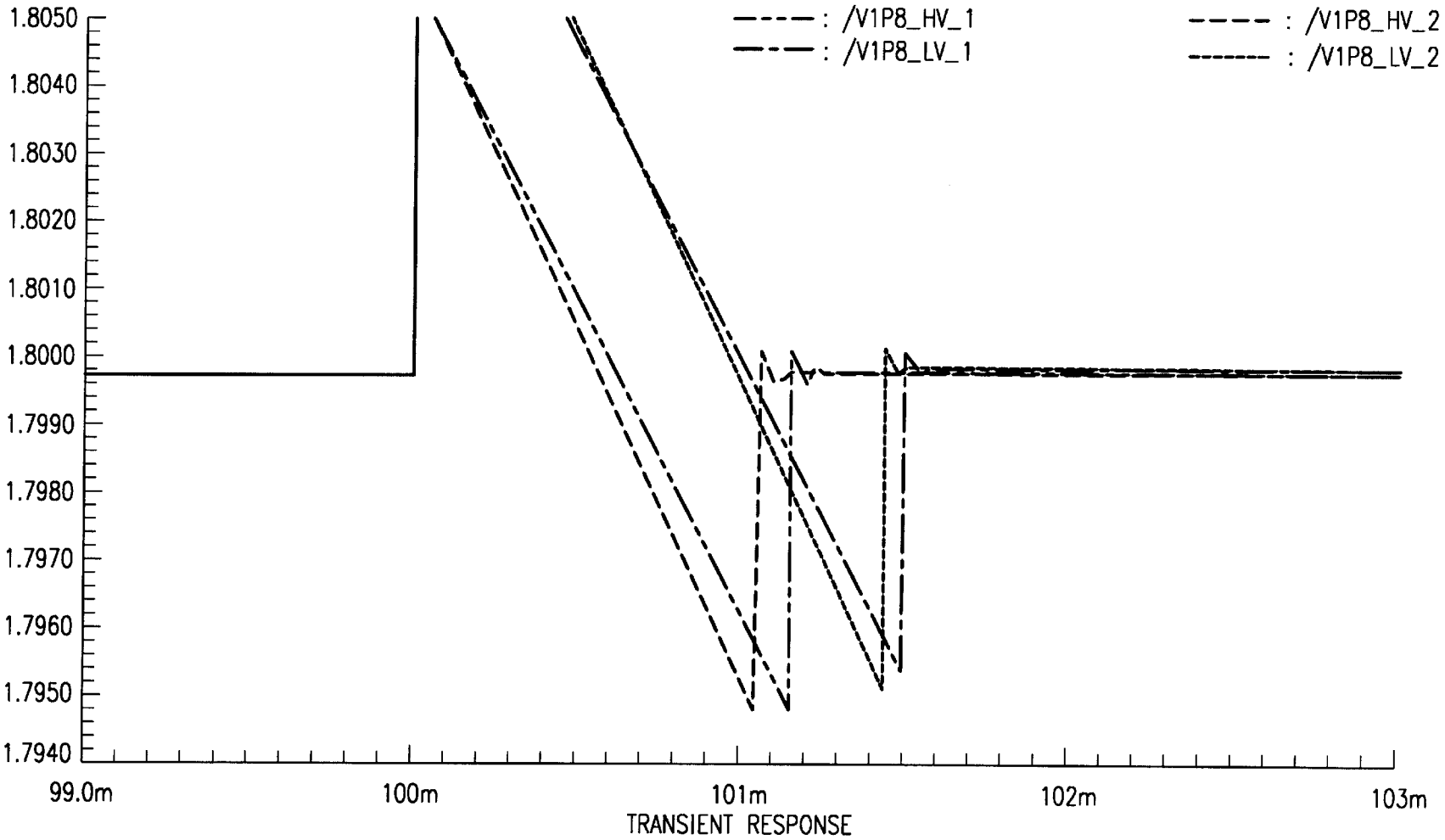
FIG. 28 illustrates a transient response simulation when switching from maximum load to no load conditions with 2 ohm ESR and 1 μF CFILT for the PMOS LDO shown in FIG. 16.

FIGS. 23–28 illustrate transient response curve sets for simulations associated with the PMOS LDO 600, wherein FIG. 23 illustrates a transient response simulation of no load and maximum load conditions with 50 m ohm ESR and 1 μF CFILT for the PMOS LDO 600 shown in FIG. 16; FIG. 24 illustrates a transient response simulation when switching from no load to maximum load conditions with 50 m ohm ESR and 1 μF CFILT for the PMOS LDO 600 shown in FIG. 16; FIG. 25 illustrates a transient response simulation when switching from maximum load to no load conditions with 50 m ohm ESR and 1 μF CFILT for the PMOS LDO 600 shown in FIG. 16; FIG. 26 illustrates a transient response simulation of no load and maximum load conditions with 2 ohm ESR and 1 μF CFILT for the PMOS LDO 600 shown in FIG. 16; FIG. 27 illustrates a transient response simulation when switching from no load to maximum load conditions with 2 ohm ESR and 1 μF CFILT for the PMOS LDO 600 shown in FIG. 16; and FIG. 28 illustrates a transient response simulation when switching from maximum load to no load conditions with 2 ohm ESR and 1 μF CFILT for the PMOS LDO 600 shown in FIG. 16.

The present invention therefore, implements a modified Miller compensation scheme using a non-inversion variable gain amplifier 202 in a manner that boosts the Gm of the power PMOS 206 at low load current to push out the second pole, which is $$f_{p2} = \frac{G_m}{2\pi \cdot CFILT},$$

beyond unity-gain bandwidth. A unity-gain feedback buffer (rail-to-rail to accommodate low supply digital processes), is employed to drive the power PMOS 206 so the pole at its gate is out of the band of interest. The present scheme cuts down the gain of non-inversion amplifier 202 when the load current is high where the Gm of the PMOS 206 is dramatically higher to ensure the second stage itself will have phase margin at $f_{p2}$. Finally, the Miller capacitor 208 is tied to a node 222 which is referenced to ground so that it won't degrade the PSRR. In view of the foregoing, it can be seen the present invention presents a significant advancement in the art of internally compensated low drop-out voltage regulators using an output PMOS pass device.

This invention has been described in considerable detail in order to provide those skilled in the damping circuit art with the information needed to apply the novel principles and to construct and use such specialized components as are required. In view of the foregoing descriptions, it should be apparent that the present invention represents a significant departure from the prior art in construction and operation. However, while particular embodiments of the present invention have been described herein in detail, it is to be understood that various alterations, modifications and substitutions can be made therein without departing in any way from the spirit and scope of the present invention, as defined in the claims which follow. For example, while the embodiments set forth herein illustrate particular types of transistors, the present invention could just as well be implemented using a variety of transistor types including, but not limited to, e.g. CMOS, BiCMOS, Bipolar and HBT, among others. Further, while particular embodiments of the present invention have been described herein with reference to structures and methods of current and voltage control, the present invention shall be understood to also parallel structures and methods of current and voltage control as defined in the claims.

What is claimed is:

1. A modified Miller-compensated voltage regulator having a unity gain frequency, the voltage regulator comprising:

an input error amplifier stage comprising a differential amplifier having an output, a first input and a second input;

a non-inversion variable gain amplifier stage having an output, a first input in communication with the differential amplifier output, and a second input connected to a dc voltage referenced to ground;

a unity gain buffer amplifier stage having an output, a first input in communication with the non-inversion amplifier stage output and a second input coupled to the output of the unity gain buffer amplifier stage;

a power PMOS having a gate in communication with the unity gain buffer amplifier stage output, a source coupled to a supply voltage and a drain that is configured to provide a regulated output voltage; and a compensating capacitor coupled at one end to the drain of the power PMOS and coupled at its other end to the output of the input error amplifier stage to provide a compensation loop having internal poles and a unity gain frequency associated therewith.

2. The modified Miller compensated voltage regulator according to claim 1 further comprising a filter capacitor coupled at one end to the drain of the power PMOS and coupled at its opposite end to ground.

3. The modified Miller compensated voltage regulator according to claim 1 further comprising a voltage divider coupled to the drain of the power PMOS and configured to provide a feedback voltage to the second input of the differential amplifier.

4. The modified Miller compensated voltage regulator according to claim 3 wherein the first input of the differential amplifier is coupled to a predetermined reference voltage.

5. The modified Miller compensated voltage regulator according to claim 1 wherein the non-inversion variable gain amplifier is operational to adjust its gain in response to a load current such that as the load current increases, the gain decreases, wherein the unity gain bandwidth associated with the loop formed by the compensating (Miller) capacitor is kept substantially constant.

6. The modified Miller compensated voltage regulator according to claim 1 wherein the non-inversion variable gain amplifier is operational to push the internal poles in the compensation loop itself formed by the compensating capacitor to frequencies above the unity gain frequency associated with the compensation loop.

7. The modified Miller compensated voltage regulator according to claim 1 wherein the non-inversion variable gain amplifier is operational to adjust its gain in response to a load current such that as the load current decreases, the gain increases, wherein a second pole associated with the voltage regulator is pushed away from the unity gain frequency associated with the voltage regulator.

8. A modified Miller compensated voltage regulator comprising:

a differential amplifier input stage having a first input, a second input, and an output;

a non-inversion variable gain amplifier stage having an output, a first input connected to a reference voltage, and a second input coupled to the output of the differential amplifier input stage;

a PMOS output transistor having a source, drain and gate;

a unity gain buffer coupling the non-inversion variable gain amplifier stage to the gate of the PMOS output transistor; and a feedback capacitor coupled at a first end to the PMOS output transistor drain, and coupled at a second end to the non-inversion variable gain amplifier stage second input to form a compensation loop; wherein the non-inversion variable gain amplifier stage, the unity gain buffer, the PMOS output transistor, and the feedback capacitor are responsive to a changing load current to control a unity gain bandwidth associated with the compensation loop.

9. The modified Miller compensated voltage regulator according to claim 8 wherein the feedback capacitor is referenced at both ends to a common ground associated with the voltage regulator.

10. The modified Miller compensated voltage regulator according to claim 8 further comprising a filter capacitor (CFILT) coupled at one end to the drain of the power PMOS and coupled at its opposite end to ground.

11. The modified Miller compensated voltage regulator according to claim 10 wherein the unity gain bandwidth associated with the compensation loop is defined by the equation $$f_{bwMILLER} = \frac{A_2 \cdot G_{mMPO}}{2\pi \cdot CFILT},$$

where $A_2$ is a gain associated with the non-inversion variable gain amplifier and $G_{mMPO}$ is a transconductance associated with the power PMOS.

12. A modified Miller compensated voltage regulator comprising:

an input amplifier stage configured to receive an input reference voltage and further configured to receive a feedback current via a nested Miller compensation capacitor associated with the voltage regulator to generate a displacement current to provide an effective Miller multiplied compensating capacitance;

a non-inversion variable gain amplifier stage having an output pole associated therewith, the non-inversion variable gain amplifier stage configured to receive the feedback displacement current associated with the nested Miller compensation capacitor such that the pole associated with the output of the non-inversion variable gain amplifier stage is pushed out to a frequency above a Unity Gain Frequency associated with the compensation loop and further configured to generate an amplified displacement current signal therefrom; and an output amplifier stage having a pole associated therewith, the output amplifier stage configured to receive the amplified displacement current signal such that the pole associated with the output amplifier stage is pushed out to a frequency above the Unity Gain Frequency of the compensation loop thereby rendering the voltage regulator output stage capable of generating a stable regulated output voltage at frequencies in the vicinity of the control loop bandwidth associated with the voltage regulator.

13. A modified Miller compensated voltage regulator comprising:

means for generating a feedback current;

means for generating a displacement current from the feedback current;

means for amplifying the displacement current such that non-dominant poles associated with the voltage regulator are pushed to frequencies outside the control loop bandwidth of the voltage regulator; and means for generating output voltage signals having substantially maximized power supply ripple rejection characteristics inside the control loop bandwidth.

14. The modified Miller compensated voltage regulator according to claim 13 wherein the means for generating a feedback current comprises a power PMOS device.

15. The modified Miller compensated voltage regulator according to claim 14 wherein the means for generating output voltage signals having substantially maximized power supply ripple rejection characteristics inside the control loop bandwidth comprises a unity gain buffer configured to receive the displacement current and drive the power PMOS device therefrom.

16. The modified Miller compensated voltage regulator according to claim 14 wherein the means for generating output voltage signals having substantially maximized power supply ripple rejection characteristics inside the control loop bandwidth comprises a source follower configured to receive the displacement current and drive the power PMOS device therefrom.

17. The modified Miller compensated voltage regulator according to claim 14 wherein the means for generating a feedback current further comprises a nested Miller compensation capacitor.

18. The modified Miller compensated voltage regulator according to claim 17 wherein the nested Miller compensation capacitor is configured such that each capacitor node is referenced to a common ground associated with the voltage regulator.

19. The modified Miller compensated voltage regulator according to claim 13 wherein the means for generating a displacement current comprises a voltage divider.

20. The modified Miller compensated voltage regulator according to claim 13 wherein the means for amplifying the displacement current such that non-dominant poles associated with the voltage regulator are pushed to frequencies outside the control loop bandwidth of the voltage regulator comprises a non-inversion variable gain amplifier.

21. A modified Miller compensated voltage regulator comprising:

a supply voltage node;

an output voltage node;

a ground;

an output power PMOS device having a source connected to the supply voltage node, a drain connected to the output voltage node, and a gate;

a common source PMOS device having a source connected to the supply voltage node, a gate connected to the gate of the power PMOS device, and a drain;

a unity gain buffer having a bias input connected to the drain of the common source PMOS device, an output connected to the gate of the power PMOS device, an inverting input connected to the buffer output, and a non-inverting input;

a non-inversion variable gain amplifier having an output connected to the unity gain buffer non-inverting input, a reference voltage input connected to a ground reference voltage, and a non-inverting input;

a differential amplifier having a bias input connected to the supply voltage node, an output connected to the non-inverting input of the non-inversion variable gain amplifier, an inverting input connected to a reference voltage, and a non-inverting input;

a voltage divider network having a first node connected to the power PMOS drain, a second node connected to ground, and a third node connected to the differential amplifier non-inverting input to provide a feedback voltage; and a compensation capacitor connected at one end to the power PMOS device drain and connected at an opposite end to differential amplifier output.

22. The modified Miller compensated voltage regulator according to claim 21 further comprising a filter capacitor coupled at one end to the drain of the power PMOS device and connected at its opposite end to ground.

23. The modified Miller compensated voltage regulator according to claim 22 wherein the non-inversion variable gain amplifier, unity gain buffer, the power PMOS device, common source PMOS device, voltage divider network, filter capacitor, and compensation capacitor are responsive to a changing load current to control a unity gain bandwidth associated with the compensation loop.

24. The modified Miller compensated voltage regulator according to claim 21 wherein the non-inversion variable gain amplifier is operational to adjust its gain in response to a load current passing through the power PMOS device such that as the load current decreases, the gain increases, wherein a second pole associated with the voltage regulator is pushed above a unity gain frequency associated with the voltage regulator.

25. The modified Miller compensated voltage regulator according to claim 21 wherein the non-inversion variable gain amplifier is operational to adjust its gain in response to a load current passing through the power PMOS device such that as the load current increases, the gain decreases, wherein the voltage regulator unity gain bandwidth associated with a loop formed by the compensation capacitor is dept substantially constant.

* * * * *